US005806403A

United States Patent [19]

Johnston

[11] Patent Number: 5,806,403

[45] Date of Patent: Sep. 15, 1998

[54] MULTICYCLINDER SELF-STARTING UNIFLOW ENGINE

[76] Inventor: Barry Johnston, 2423 Pickwick Rd., Baltimore, Md. 21207

[21] Appl. No.: 662,301

[22] Filed: Jun. 12, 1996

Related U.S. Application Data

[63] Continuation of Ser. No. 459,625, Jun. 2, 1995, abandoned, which is a continuation of Ser. No. 254,465, Jun. 6, 1994, abandoned, which is a continuation of Ser. No. 773,926, Nov. 6, 1991, abandoned.

[30] Foreign Application Priority Data

Jan. 4, 1990 [WO] WIPO ..... PCTUS9000091

[51] Int. Cl.[6] ..... F01L 15/12; F01L 21/04

[52] U.S. Cl. ..... 91/224; 91/229; 91/336

[58] Field of Search ..... 60/369, 370, 371, 60/375, 376, 381, 383, 670, 671; 91/218, 221, 224, 229, 335, 336

[56] References Cited

U.S. PATENT DOCUMENTS

| | | | |
|---|---|---|---|
| 2,649,078 | 8/1953 | Kelly | 91/220 |
| 3,079,900 | 3/1963 | Hunnicutt | 91/303 |
| 3,885,387 | 5/1975 | Simington | 60/370 |
| 3,932,989 | 1/1976 | Demetrescu | 60/383 X |
| 4,052,850 | 10/1977 | Mohaupt | 60/371 X |
| 4,110,981 | 9/1978 | Murphy | 60/371 |
| 4,698,973 | 10/1987 | Johnston | 60/670 |
| 4,947,731 | 8/1990 | Johnston | 91/229 |

*Primary Examiner*—Hoang Nguyen
*Attorney, Agent, or Firm*—Lowe Hauptman Gopstein & Berner

[57] ABSTRACT

A uniflow engine has a plurality of cylinders disposed symmetrically around a common crankshaft connected to pistons reciprocating in the cylinders. In response to the availability of a working fluid vapor at a predetermined condition, such as a high pressure or temperature, incoming vapor is supplied to those cylinders in which the respective pistons are in their working strokes to thereby initiate rotation of the crankshaft in which the crankshaft had stopped last. Once rotation is initiated and a predetermined mode change speed attained in a "start-up model" by engine operation from start, vapor inlet valves are controlled to change engine operation over to a "running mode". In the "start-up mode" incoming vapor is admitted over a substantial portion of the piston working stroke, whereas in the "running mode" vapor inflow is terminated relatively early in the working stroke so that a vapor change does work in expending against the piston.

20 Claims, 15 Drawing Sheets

MULTICYCLINDER SELF-STARTING UNIFLOW ENGINE

This application is a continuation of application Ser. No. 08/459,625 filed Jun. 2, 1995, now abandoned, which is a continuation of application Ser. No. 08/254,465 filed Jun. 6, 1994, now abandoned, which is a continuation of application Ser. No. 07/773,926 filed Nov. 6, 1991, now abandoned

FIELD OF THE INVENTION

This invention relates to a multicylinder vapor powered reciprocating engine and, more particularly, to such an engine having the inherent capability for restarting after a total stop solely in response to the availability of working fluid vapor at a predetermined condition regardless of crankshaft position when the engine last ceased operation.

BACKGROUND OF THE PRIOR ART

There are many circumstances where rotary mechanical power from a totally self-contained unit is highly desirable, e.g., to power an artesian pump in a remote desert location where the only source of energy is the sun. The engine should operate over a long period of time without the need for any external source of electricity or manual inputs to restart it after a stop or to control its operation between stops. It is also absolutely essential that the engine, when provided with working fluid vapor at a predetermined condition, has the capacity for starting automatically, operating satisfactorily thereafter, ceasing operation when working fluid vapor is no longer available at the predetermined condition, and stopping in readiness for the next automatic restart—all without human intervention except for repair or scheduled maintenance.

Conventional closed loop solar collector systems typically are designed to include one or more electrically-operated servo-type valves to control engine vapor intake and to regulate the output of the engine to maximize operational efficiency. Such controls, however, reguire an external source of electrical power and are not particularly suitable for unattended operation over prolonged periods of time in remote areas. Likewise, it is preferable to eliminate the need for manual controls. Furthermore, it is highly desirable to completely seal-in the operating components of the engine to preclude contamination by dirt, moisture and other ambient pollutants and to maintain within the engine a subatmospheric pressure or vacuum for higher operational efficiency.

In my earlier issued U.S. Pat. No. 4,698,973, titled "CLOSED LOOP SOLAR COLLECTOR SYSTEM POWERING A SELF-STARTING UNIFLOW ENGINE", issued on Oct. 13, 1987 and incorporated herein by reference, there is disclosed and claimed a closed loop solar collector system that receives collected solar energy to vaporize a working fluid for delivery to a single piston uniflow system. The disclosed engine includes a single piston capable of acting directly upon a pair of normally closed intake valves projecting into the engine cylinder to actuate the same. Under relatively low pressure conditions in the boiler or vaporizing unit, a spring-loaded connecting rod facilitates control of the engine so that, in principle, the engine has the ability to start when available working fluid vapor attains a predetermined pressure and, thereafter, changing over from a start-up mode to a normal running mode of operation when the rotational speed of the engine attains a predetermined mode-change value. It is believed, however, that a single piston reciprocating in a single long cylinder could possibly come to a stop in an end-of-stroke position that may frustrate a subsequent restart. In other words, to promote wide use of uniflow engines with closed loop solar powered systems, it is believed necessary to have a sealed-in engine that will always start when working fluid vapor is delivered at a certain minimum pressure regardless of the engine crankshaft position when it comes to a stop.

The present invention, therefore, provides a multicylinder uniflow engine designed to restart readily no matter what position the crankshaft takes when the engine comes to a stop. The engine will always restart when working fluid vapor is available to the engine at a predetermined condition, e.g., when the static pressure of the working fluid vapor exceeds a predetermined value.

It should be appreciated that an engine of the type taught in this invention preferably should have as few mechanical moving parts as practical, be capable of completely sealed-in operation, and have a simple sturdy design, e.g., not be dependent on springs that may lose their elasticity or break over time, so that it will not require expensive or difficult production techniques or maintenance after installation.

DISCLOSURE OF THE INVENTION

It is, accordingly, an object of this invention to provide a multicylinder engine utilizing pressurized working fluid vapor ("incoming vapor" hereinafter) which will start automatically when one or more selected engine operating parameters meet corresponding predetermined criteria.

Another object of this invention is to provide a multicylinder, self-starting, simple engine suitable for integration into a closed loop solar energy collection system that generates a supply of working fluid vapor.

Yet another object of this invention is to provide a multicylinder uniflow engine of which most operating components are sealed-in to operationally communicate solely with a closed loop vapor system for providing to and receiving therefrom incoming vapor at a predetermined working condition.

Related further objects of this invention are to provide a multicylinder uniflow engine with a common crankshaft that will start in any position of the crankshaft when incoming vapor is made available at not less than a predetermined working pressure with or without rotating control elements.

Another related object of this invention is to provide a multicylinder uniflow engine with a common crankshaft that will start in any position of the crankshaft when incoming vapor is made available at not less than a predetermined temperature.

An even further object of this invention is to provide a multicylinder uniflow engine which upon starting from a total stop initially operates in a "start-up mode" characterized by the utilization of incoming vapor at a relatively high inlet pressure without expansion during a corresponding piston stroke in each cylinder, followed upon the attainment of a predetermined engine operating condition by a normal running mode characterized in that incoming vapor at high inlet pressure is received for only an initial portion of each working stroke and thereafter expands for the rest of the working stroke for efficient engine operation.

These and other objects of the invention are realized by providing in a self-starting, multicylinder, single crankshaft, reciprocating piston engine supplied with an expandable working fluid and having at least three cylinders evenly distributed around a common crankshaft, a first means for forcibly adjusting position in response to an output speed of the engine and a second means for controlling the start and stop of inflow of the working fluid sequentially into the cylinders as a function of the individual piston positions with respect to TDC during their working strokes in correspondence with the instantaneous position of the first means.

In different aspects of the invention, control of the engine operation from zero speed, through a "start-up mode" (during which working fluid moves the pistons without expansion), through a predetermined mode change speed and into a "running mode" (during which a charge of working fluid expands during each piston working stroke), is effected in response to an engine output rotational speed, or the pressure or temperature at which the working fluid is available.

In one alternative embodiment of the invention, a relief valve is provided in the head of each piston and is actuated during operation of the engine by inertia forces only, thus avoiding the use of springs and problems incidental thereto.

In a further improvement of the invention a mode change/fine-tuning valve mechanism is provided to ensure optimum utilization of the enthalpy provided to the engine in the working fluid.

BRIEF DESCRIPTION OF THE DRAWING

FIGS. 1A, 1B and 1C, respectively, are enlarged cross-sectional views of cylinders A, B and C as identified in FIG. 1, each in the "running mode".

DESCRIPTION OF THE PREFERRED EMBODIMENTS

Figure 1:
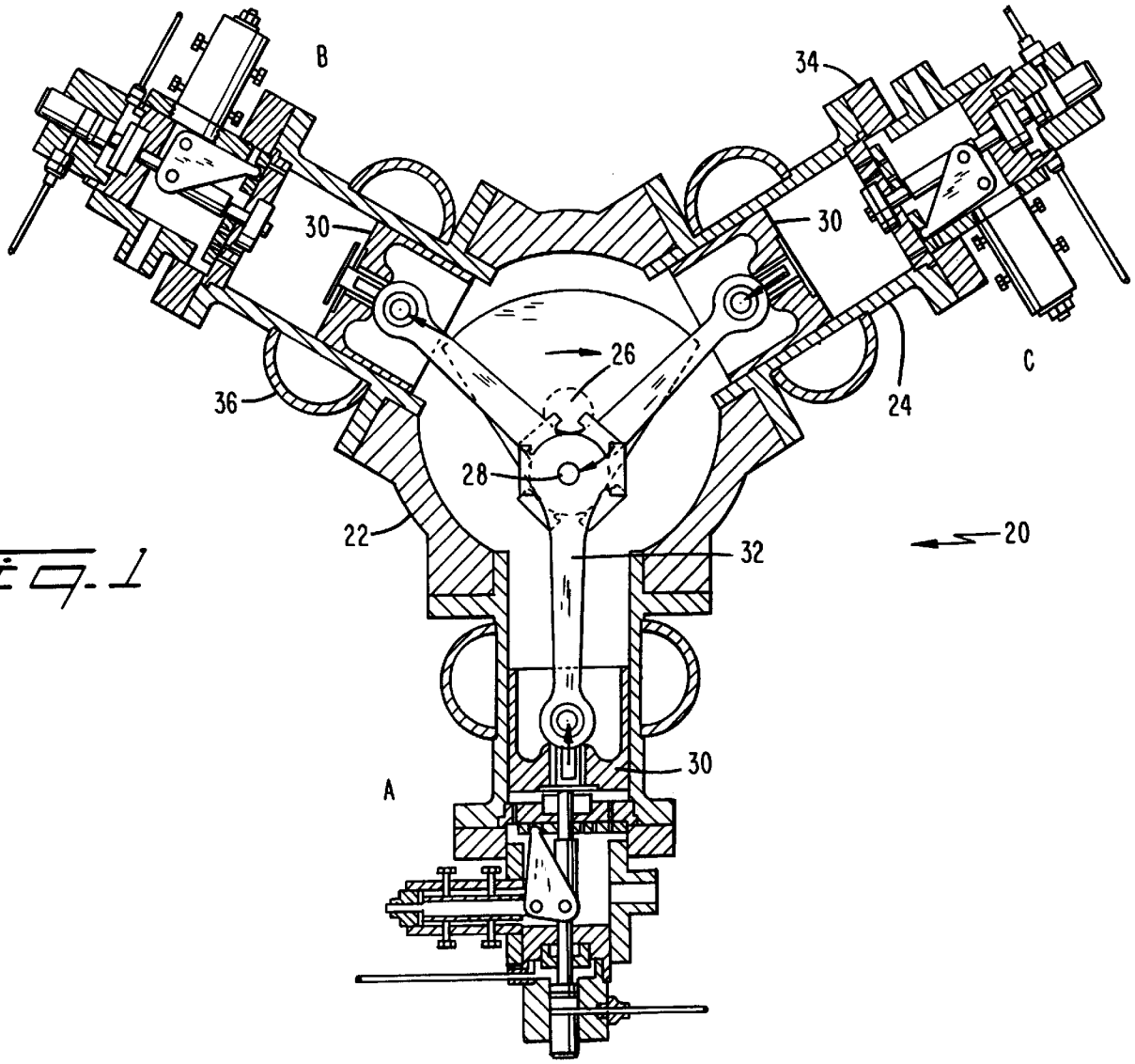
FIG. 1 is cross-sectional view of a preferred embodiment of a multicylinder uniflow engine in its "running mode", in planes normal to the common crankshaft of a multicylinder engine, wherein each cylinder assembly is sectioned along its longitudinal axis.

The multicylinder self-starting uniflow engine according to this invention will efficiently operate as an integral part of a closed loop vapor cycle system. As discuss extensively in my earlier-issued U.S. Pat. No. 4,698,973, incorporated herein by reference, such a closed loop thermodynamic system typically will have a boiler or other vaporizing element in which a working fluid is provided with thermal energy, say by focused sunlight from a solar collector, and undergoes a phase change from its liquid to a vaporized state. The high pressure vaporized vapor fluid is then made available to the plurality of cylinders of the engine to be controllably admitted thereto (in a manner to be described) to exert mechanical force on a corresponding piston in each cylinder, thereby to provide a torque to a common crankshaft At or near the and of the working stroke of each piston within its corresponding cylinder in normal operation, the incoming vapor that has experienced a loss of enthalpy (which was substantially converted into useful mechanical work on the piston) exhausts from the cylinder into an exhaust pipe or manifold that typically leads it to a condenser unit, after passage through a regenerating heat exchanger of known type if one is provided in the system. Heat is removed from the exhausted vapor in the condenser unit, e.g., to a flow of cooling water if such is available or by radiation and convection to the atmosphere otherwise, and the low-enthalpy fluid vapor is condensed into its liquid form, typically at a subatmospheric or pressure "vacuum". This condensate, with or without regenerative heating thereof in the regenerating heat exchanger, is collected and returned to the boiler.

In this manner, a working fluid undergoes a succession of phase and pressure changes to convert part of the thermal energy provided to the system into a mechanical work output, typically as an output torque at a driven shaft to rotate driven equipment, e g., a pump. Since the basic elements such as the boiler recirculating pump or means, the condenser, working fluid storage means, regenerative heat exchangers and piping are well understood standard components of said system, detailed descriptions thereof are believed unnecessary. What is important to realize is that the multicylinder, self-starting, uniflow engine of this invention is advantageously connected to such a system so as to receive therefrom a working fluid vapor at a pressure or temperature that has a predetermined value or is within a predetermined pressure or temperature range and is also connected to a condenser element in the overall system for receiving and condensing thereby of exhausted working fluid vapor from the various cylinders of the uniflow engine.

There are numerous commercially available devices, includable in a closed loop system between the boiler element and the engine, that permit flow of a working fluid vapor from the boiler to an energy-utilizing device such as an engine only when the working fluid vapor attains a predetermined condition, e.g., static pressure, temperature or the like. Such conventional devices may be adjustable to enable a user to select the value or range at which the device will act. It is believed that persons skilled in the relevant arts will be familiar with the availability and manner of use of such devices, hence a detailed description thereof is believed unnecessary.

If a uniflow engine has only one reciprocating piston in a cylinder, there is always the disconcerting probability that the piston will stop virtually at its top dead center or its bottom dead center with respect to its cylinder. Basically the same situation could arise in a uniflow engine provided with two cylinders with their axes lying in a common plane with their respective pistons operationally engaged to drive a common crankshaft, i.e., one of the pistons could be at its stop dead center (TDC) while the other is at its bottom dead center (BDC). When the one or two pistons in such engines are at their extreme ends, as a practical matter it is difficult if not impossible to initiate operation of the engine without an externally provided torque to initiate rotation of the crankshaft. For the engine of the present invention, no such input is required from an outside power source to initiate rotation of the crankshaft, i.e., the multicylinder engine is reliably self-starting. The smallest such number of cylinders is three, and the same basic principle applies for engines having larger numbers of cylinders. The present specification therefore describes in detail how a self-starting uniflow engine with a common crankshaft and three cylinders each with a single-acting piston provides numerous advantages that are particularly desirable for self-contained power units operable in remote locations with a minimum of attention.

Referring now to FIG. 1, there is shown a partial cross-sectional view of a preferred embodiment of the engine as seen in the direction of the rotational axis of a common crankshaft 26 operationally connected to three pistons 30 each slidingly contained in corresponding cylinders 24 distributed evenly, i.e., 120° apart, around said axis of rotation. It should be appreciated, and becomes clear from a quick look at FIG. 3, that because each of the connecting rods 32 has a finite dimension in the axial direction, the axes of the various cylinders are located at different axial positions along the crank 28.

Figure 11:
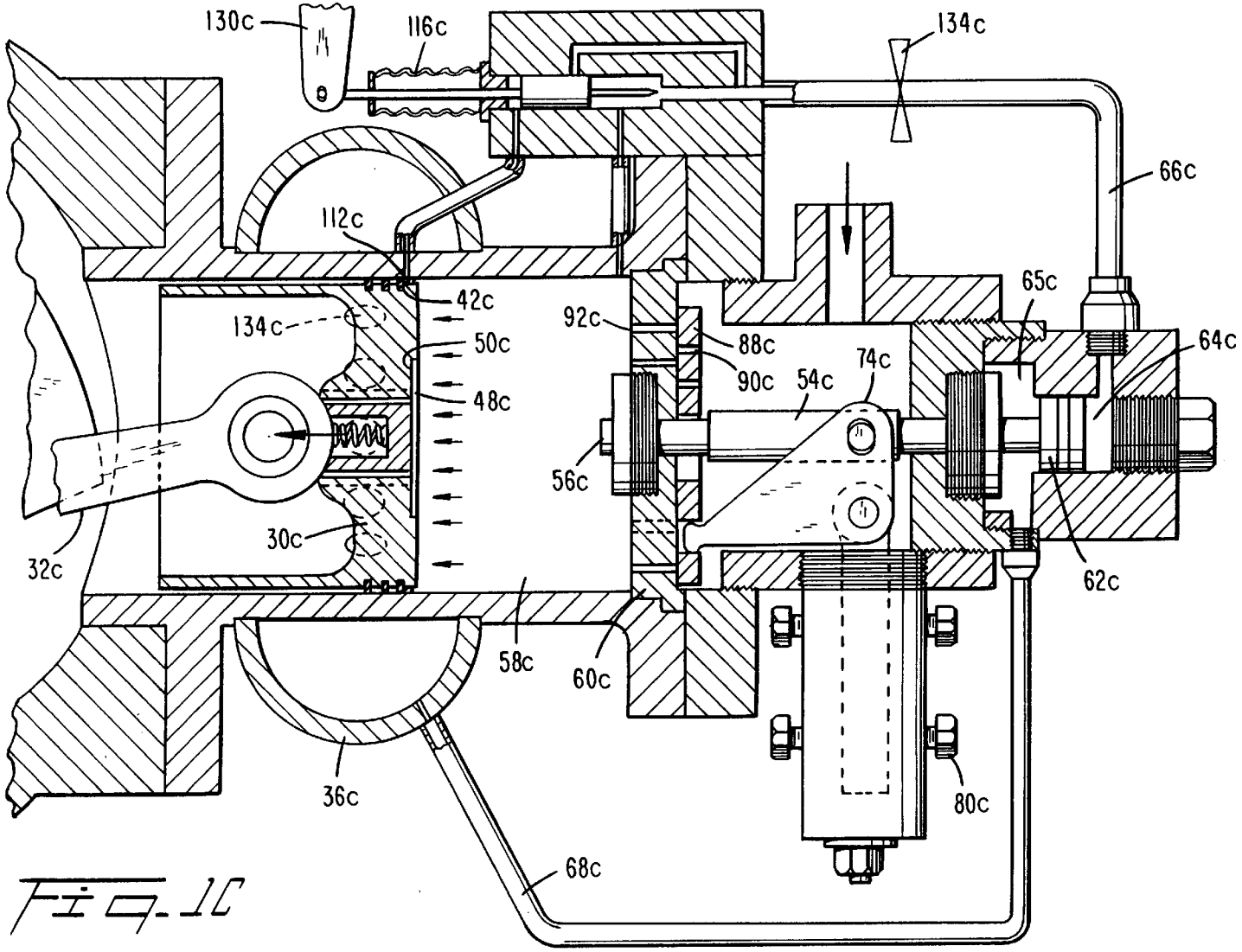
FIG. 11 is similar to FIG. 1B but illustrates an alternative embodiment in which a pressure relief valve in each piston head operates by inertial force instead of a spring force.
Figure 12:
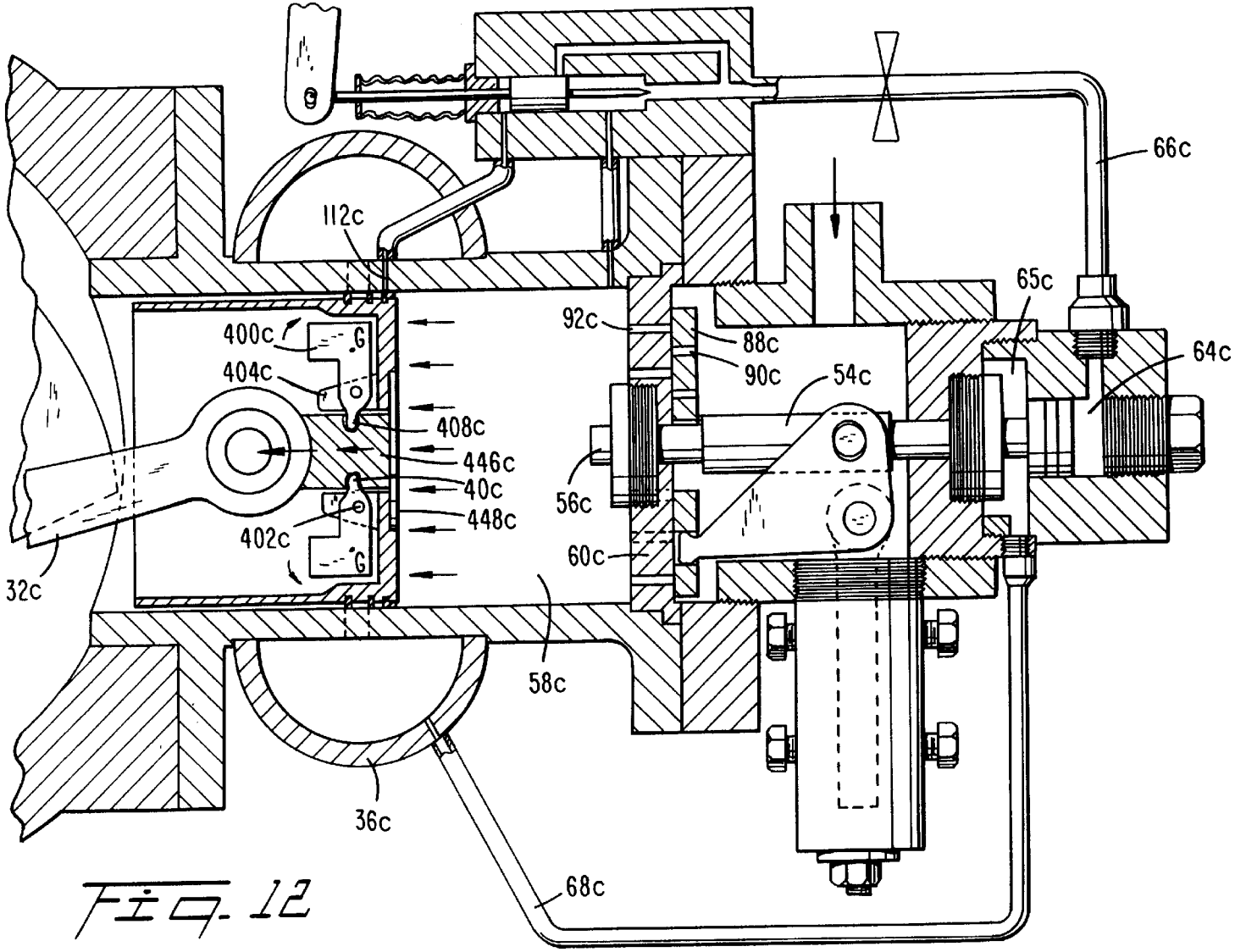
FIG. 12 is similar to FIG. 1C but illustrates an alternative embodiment in which a pressure relief valve in each piston head operates by inertial force instead of a spring force.

For ease of reference to particular elements of the engine, a subscript "a", "b", or "c" is provided immediately after numerals identifying plural similar structural elements to refer to a particular element, e.g., as found in cylinder assemblies A, B or C, respectively. Thus, for example, piston 30 in cylinder assembly A hereinafter will be identified as "30*a*", and so on whenever appropriate. In correspondence to this labeling system, FIG. 1B illustrates, in enlarged view, a preferred embodiment in a state of cylinder assembly B of FIG. 1. In a state of the cylinder assembly comparable to that of FIG. 1B, an alternative embodiment that utilizes only inertia forces instead of a spring to actuate a relief valve in each piston is illustrated in FIG. 11. In like manner, FIG. 12 is comparable to FIG. 1C in its illustration of the alternative manner of operating the relief valve.

In FIG. 1, a multi-cylinder self-starting uniflow engine 20 has a main body 22 to which are connected three symmetrically disposed cylinder assemblies 24*a*, 24*b* and 24*c*, each preferably having a horizontal axis 120° apart from each of the others. Correspondingly, the engine axis of rotation, about which the common engine crankshaft 26 rotates, is vertical. Crank 28, connected to all three pistons, therefore rotates in a horizontal circle, at a selected crank radius "r" which is one-half the stroke of each of three pistons 30*a*–30*c* reciprocating in the three corresponding cylinder assemblies 24*a*–24*c*. Each piston 30*a*–30*c* is connected to common crank 28 by means of a connecting rod 32*a*–32*c*. Each cylinder assembly 24*a*–24*c*is provided at its end remote from main body 22 with an inlet valve assembly 34*a*–34*c*. Intermediate its ends, each cylinder assembly 24*a*–24*c* is also formed to have exhaust vapor conduits 36*a*–36*c* which enable exhaustion of working fluid vapor from the corresponding cylinders to a common condenser unit (not shown) of a closed loop power generation system (of which the uniflow engine 20 is a part).

For low cost and simplicity of inventory, assembly and maintenance, engine 20 according to the present invention has identical pistons 30, connecting rods 32, cylinder assemblies 24, valve assemblies 34, and the like. Hence the following discussion relating to the structure, mode of operation, and function of a typical element or combination of elements that is repeated elsewhere in the engine can be taken as representative. Thus, for example, each piston 30 will move from its corresponding TDC in a cylinder assembly 24 in a working stroke corresponding to 180° rotation of the crank, followed by an exhaust stroke corresponding to another 180° of crank rotation, to perform one cyclical operation in one complete rotation of the crankshaft 26.

Because the three cylinders of the preferred embodiment are symmetrically separated by 120° about the vertical engine rotation axis, there is an inherent design overlap of 60°, i.e., (180°–120°) in the power strokes and exhaust strokes of successive pistons as the crankshaft rotates. The principal advantage of this is that regardless of the crank position when the engine stops at any time, upon the provision of pressurized working fluid vapor, as described hereinafter, the crankshaft will definitely rotate in its correct operational direction without the need for any external force.

Provision of cylinders in numbers larger than three will proportionately increase the extent of operational overlap between adjacent successive cylinders, but the basic principle, i.e., that there is always finite and helpful overlap, is realized by the provision of no more than three cylinders.

In FIG. 1, the engine has piston 30*a* in cylinder assembly A at its TDC, piston 30*b* in cylinder B in a position having partially completed its exhaust stroke, and piston 30*c* in cylinder C in the course of a power stroke during which it is exerting a clockwise rotational torque on crank 28. Although each piston will pass through its various positions, an understanding of the mechanism by which the engine starts at zero rotational speed, goes through its "start-up mode" and thereafter operates in its "running mode" in controllable manner, is helped by reference to the exemplary configurations shown for pistons 30*a*–30*c* in cylinders A, B and C in FIG. 1. Enlarged views of the relevant structure for these purposes are provided in FIGS. 1A, 1B and 1C hereinafter.

Figure 2:
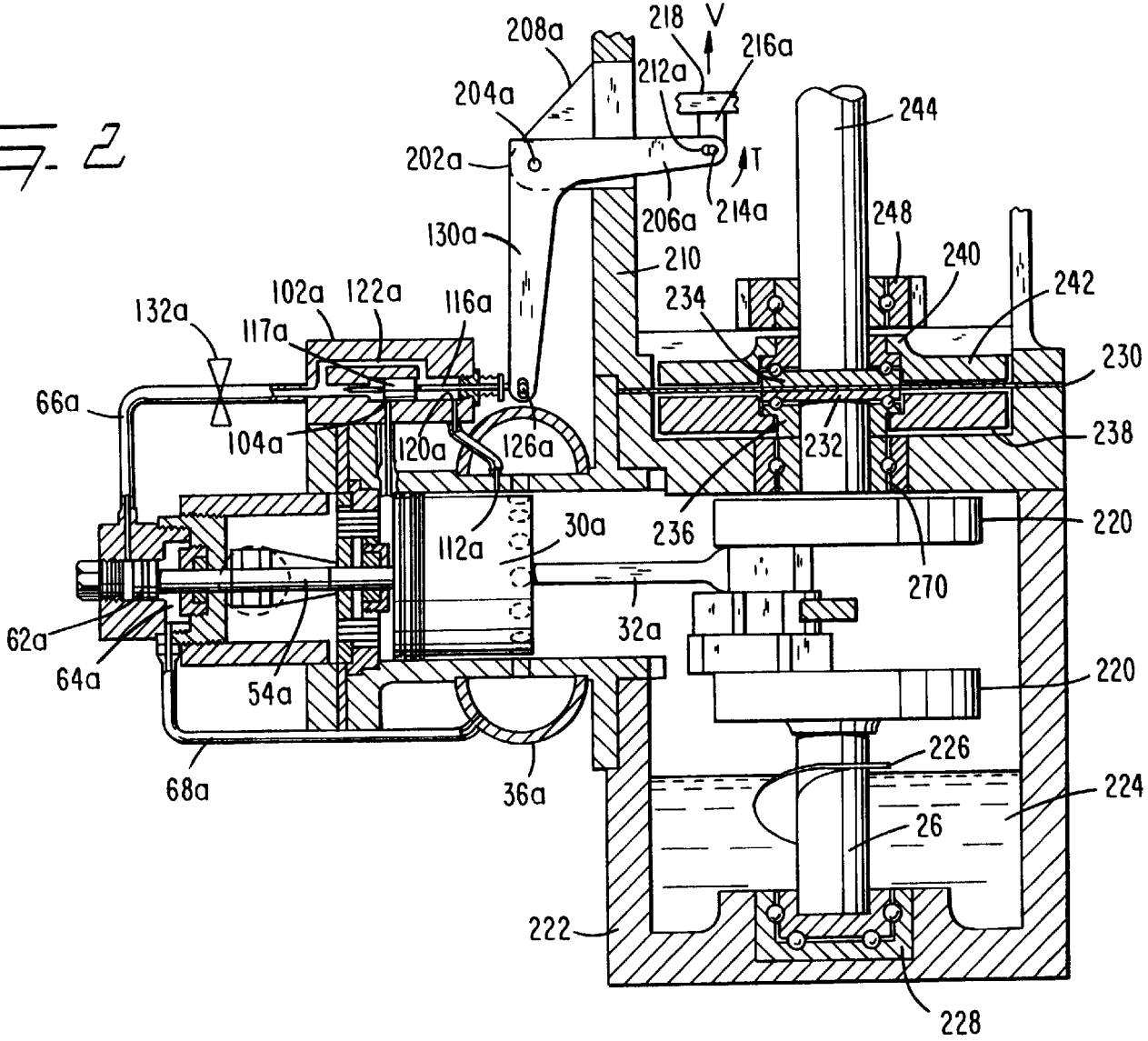
FIG. 2 is a partial vertical cross-sectional view of cylinder A in the embodiment of FIG. 1, in the "start-up mode".
Figure 3:
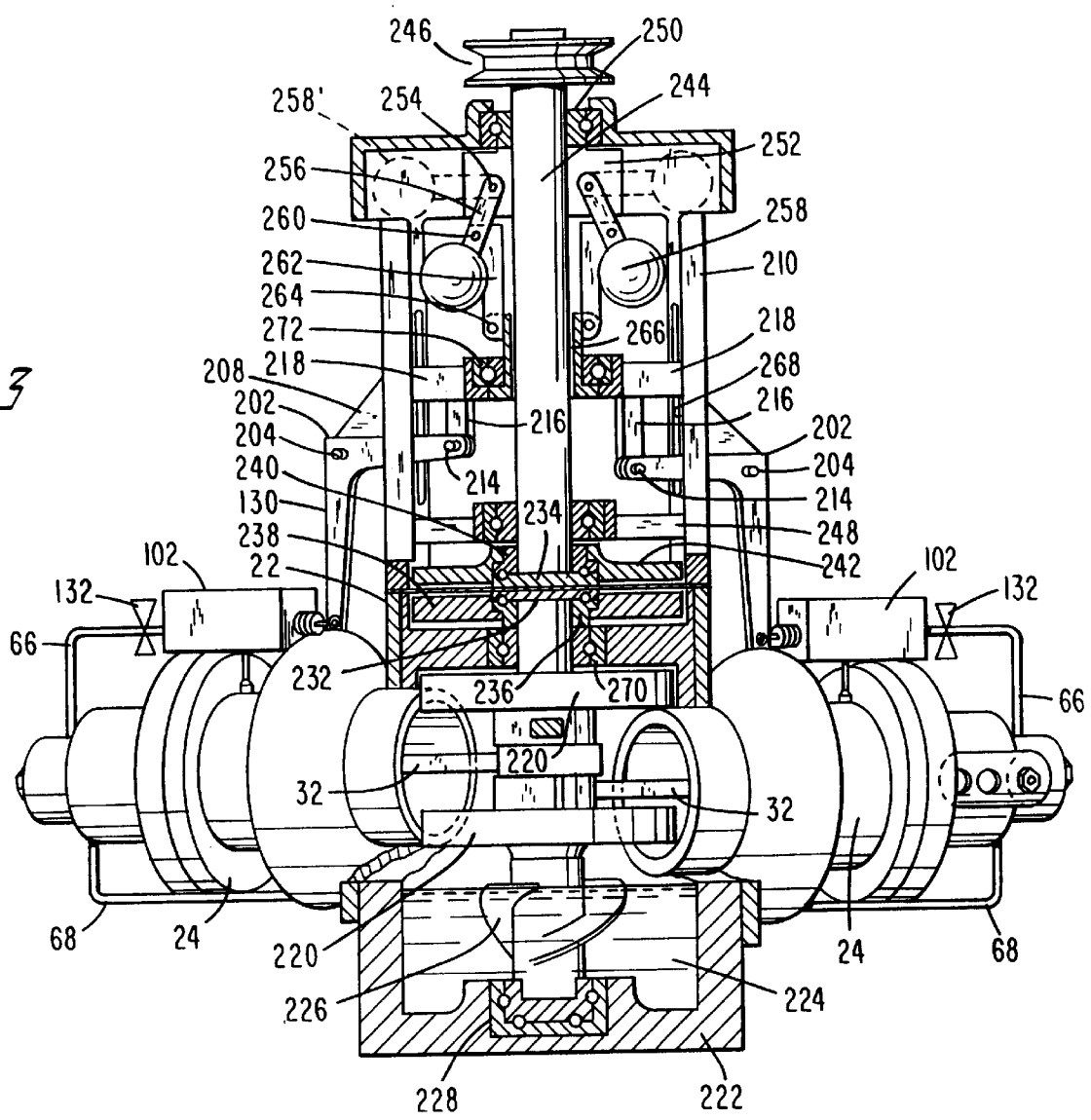
FIG. 3 is a partially sectioned and partially perspective view to illustrate, in particular, a sealing arrangement and rotating mode-change control components in a preferred embodiment.

Most of the engine operation over time is conducted in its "running mode", as illustrated in FIGS. 1 and 1A–1C. By contrast, FIGS. 2 and 3 illustrate various portions of the engine in its "start-up mode", during which initially stationary engine crankshaft 26 automatically starts rotating and undergoes rotation until a predetermined condition, e.g., a predetermined mode change sped, is attained, the operation then shifting to the "running mode".

Figure 1A:
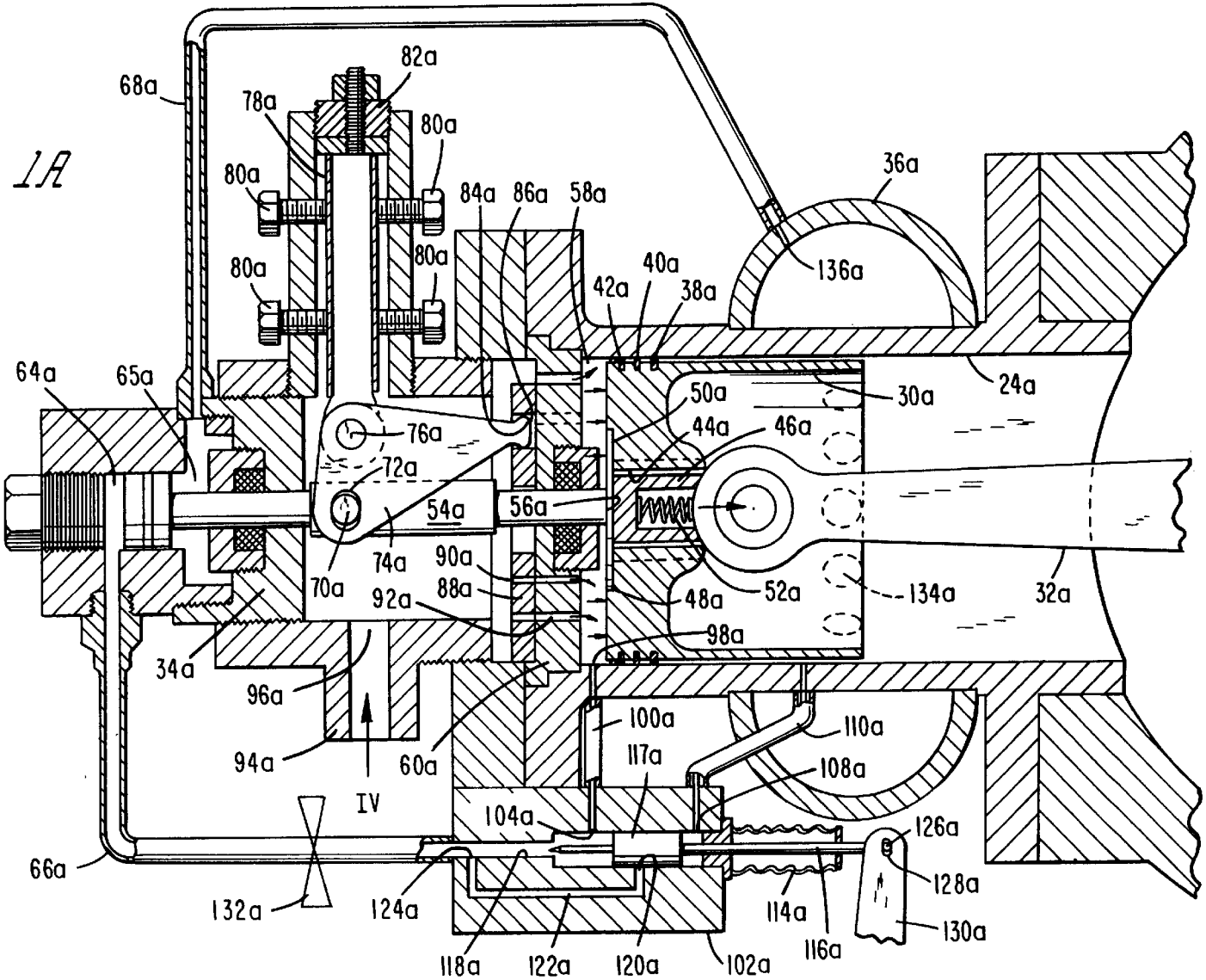
Figure 1B:
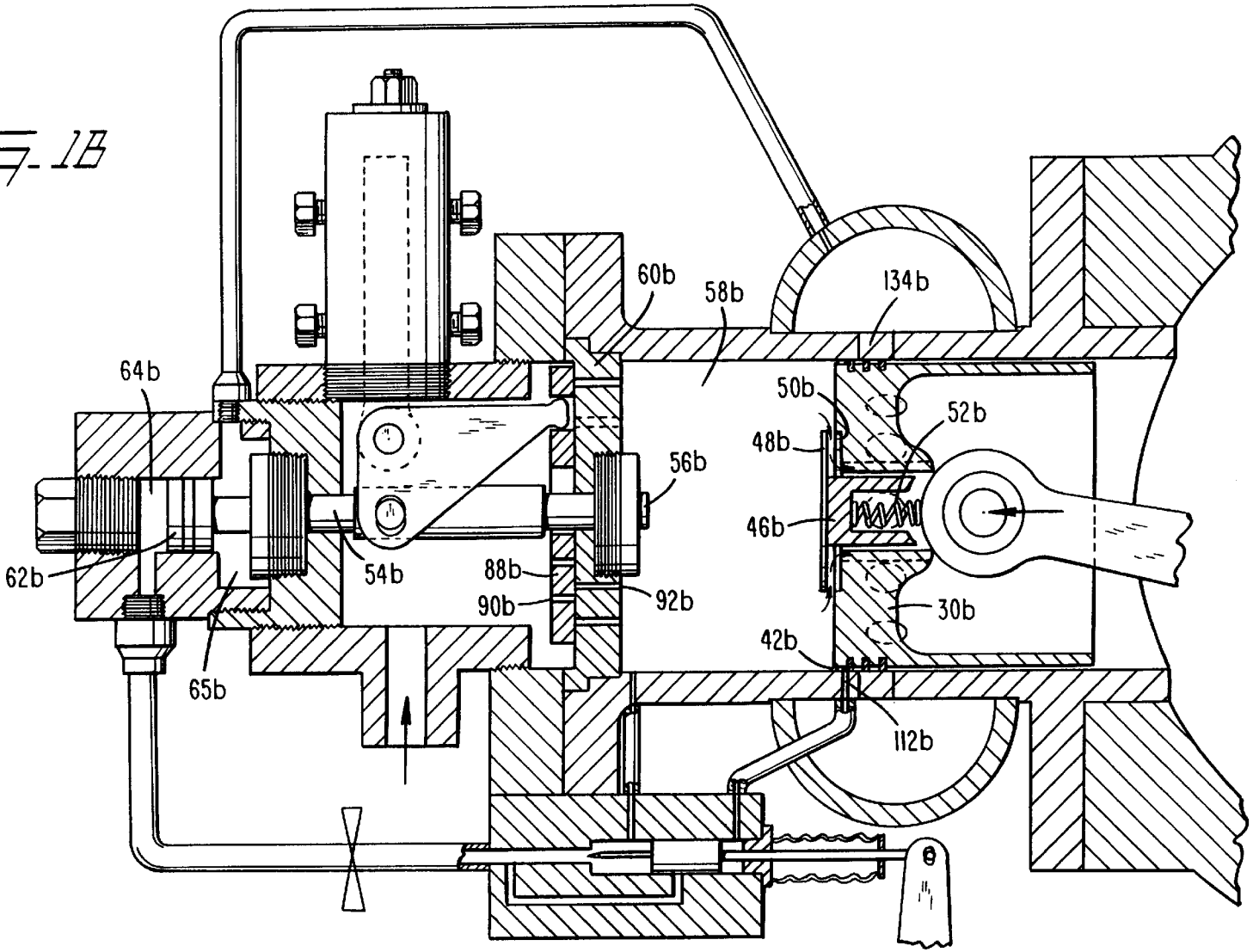

Referring to FIG. 1A, internal cylindrical surface 24*a* slidingly guides and contains piston 30*a* which has a substantially flat crown and a substantially cylindrical skirt (neither numbered for simplicity) and is provided with a plurality of grooves around the crown to contain corresponding piston rings 38*a*, 40*a* and 42*a*. The number of rings so provided will be determined by the particular application and operations conditions contemplated. It is preferable that the ring 42*a*, closest to the crown surface of the piston, be formed to have an L-shaped cross-section, per FIG. 1A, so that it has a cylindrical annular extension that may, if desired, extend beyond the crown surface of piston 30*a*. Piston rings 38*a*, 40 and 42*a*, of customary design, typically have a split and a possible end overlap thereat, so that they may be forcibly opened enough to be placed into their respective grooves.

There is a small but finite difference between the diameter of cylindrical surface 24 and the external diameter of the skirt of piston 30, hence over an extended period there will be a small leakage of fluid from the crown end of the piston, past the rings and through the small gap between the piston skirt and the interior surface 24 of each corresponding cylinder. This inevitable slow leakage serves a useful purpose in the present invention, in that once the engine stops, over a period of time the working fluid vapor in various parts of the engine has the opportunity to approach thermodynamic equilibrium. In the usual "running mode" operation this leakage is too small to matter in any single revolution of the crankshaft 26.

Referring again to FIG. 1A, piston 30*a* is provided with a cylindrical central aperture 44*a*, preferably in a pressed-in sleeve (not numbered) that may conveniently be formed of a known self-lubricating material. Within the cylindrical aperture 44*a* in slidingly contained a cylindrical portion of a relief valve 46*a* that preferably has a substantially flat and circular end flange 48*a* that is received in a matchingly shaped recess 50*a* in the crown of piston 30*a*. A compressible spring 52*a* is provided within a cavity formed in relief valve 46*a* and is shaped, sized and attached such that in the absence of an external force acting on flange 48*a*, relief valve body 46*a* slides outwardly of the crown of piston 30*a* by a predetermined small amount. When this occurs, as best understood with reference to FIG. 1B, low pressure vapor present in chamber 58 at the crown of piston 30 can readily flow past flange 48 and through the clearance between cylindrical portion 46 and the inner surface of aperture 44 or through lengthwise grooves or passages provided (but not shown for simplicity) in the sleeve defining the aperture containing valve 46 in piston 30 (letters "a" and "b" are temporarily omitted to avoid unnecessary confusion). As can be readily seen, spring 52*a*, being compressive in nature, extends with one end to act against relief valve 46*a* and with its other end to act against a top rounded end of the corresponding connecting rod 32*a*. Hence relief valve 46*a* projects outwardly by a predetermined amount except when it is acted upon by an external force so that upper flange 48*a* is pushed into and received sealingly into recess 50*a* in the crown of piston 30*a*.

Figure 8:
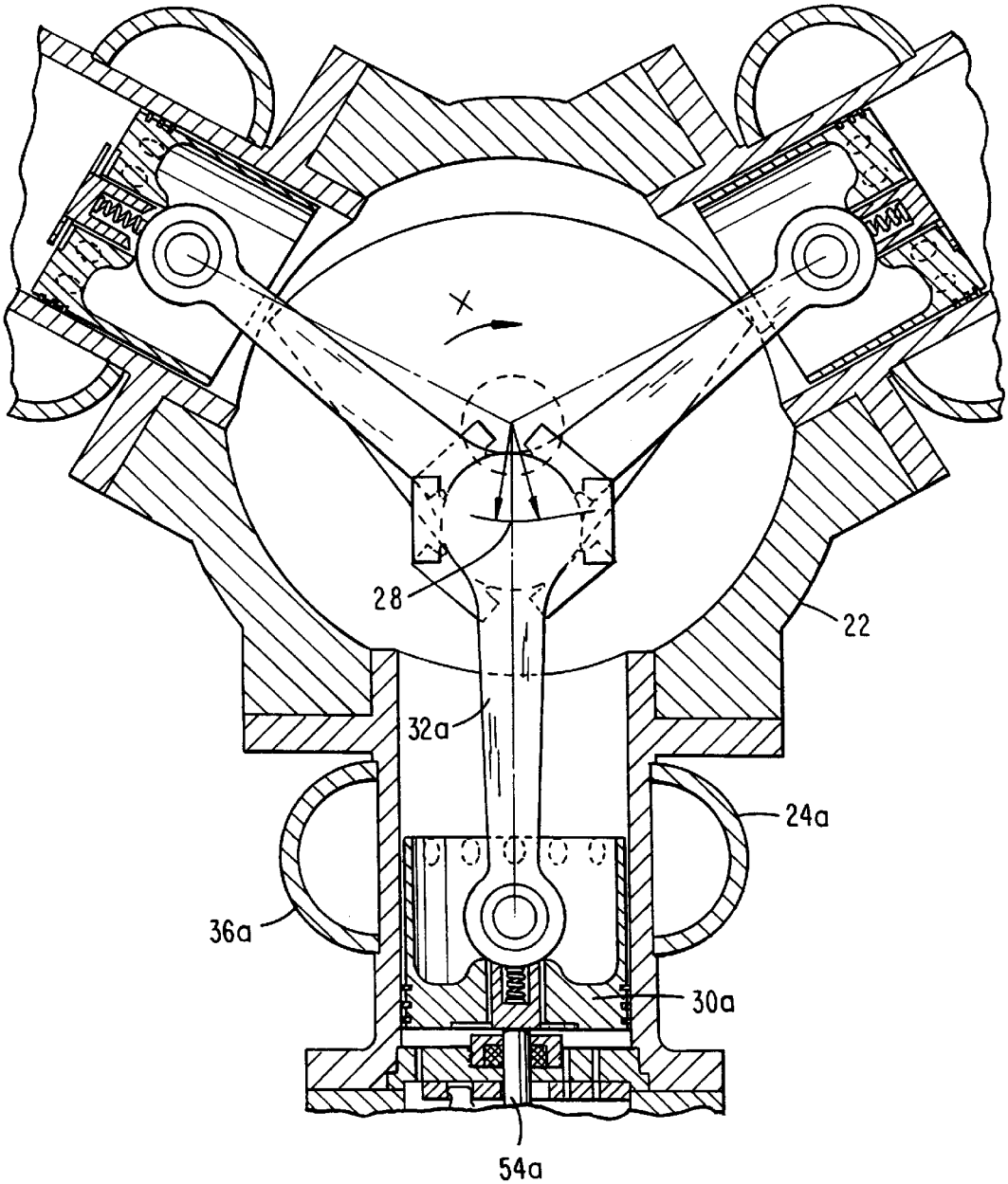
FIG. 8 is a partial cross-sectional view normal to the common crankshaft of the multicylinder engine of FIG. 1, to schematically illustrate certain angular relationships among the connecting rods when piston A is at its "top dead center" in cylinder A.

For purposes of future reference, the total flat surface at the crown end of piston 30*a* will be referred to as the "piston area" which, taking into account the annular thickness of end ring 42*a* around piston 30*a*, should be the same as the cross-sectional area of cylindrical surface 24*a*. There are two kinds of external force that will be experienced in normal operation of the engine by flange 48*a* of relief valve 46*a*. First, when piston 30*a* returns to its TDC position, as illustrated in FIGS. 1A and 8, the center of flange 48*a* makes direct forcible contact with an inlet valve rod 54*a* at end 56*a* thereof projecting into chamber 58*a*. This chamber 58*a* is defined by a cylinder head plate 60*a*, the cylindrical surface 24*a* and a combination of the flat circular face of flange 48*a* and the surrounding annular end face portion of the crown of piston 30*a*. The spring 52*a*, in part, acts as a shock absorber element in the early part of such a forcible contact between valve rod end 56*a* and flange 48*a*. The other kind of force on flange 48*a* is that due to pressurized vapor that enters chamber 58*a*. Once the forcible contact between flange 48*a* and valve rod end 56*a* brings flange 48*a* into sealing contact with piston 30*a* the inflow of such pressurized vapor acts to maintain flange 48*a* in sealing contact with piston 30*a*.

Even under circumstances where the forcible contact has not first occurred, ingress of pressurized incoming vapor into chamber 58*a* and the escape of some of it past flange 48*a*, by the Bernoulli effect, will force flange 48*a* into recess 50*a* to seal it shut. This is most likely to occur during the "start-up mode".

Inlet valve rod 54*a* is supported adjacent its end 56*a* in an aperture in the center of end plate 60*a* and close to its other end in a portion of inlet valve assembly 34*a*. At the latter and of inlet valve rod 54*a* is provided a piston 62*a*, with one or more sealing rings (not numbered) to be slidingly contained within a matchingly sized cylinder (not numbered) between chambers 64*a* and 65*a*. Chamber 64*a* communicates with a pipe 66*a* on the far side of piston 62*a* and chamber 65*a* with a second pipe 68*a* on that side of piston 62*a* which is closest to chamber 58*a*. Vapor pressure differences, as communicated to chambers 64*a* and 65*a* by pipes 66*a* and 68*a*, respectively, can be used to create a controlled differential force on piston 62*a* to drive inlet valve rod 54*a* toward piston 30*a* or away from it as needed.

Inlet valve rod 54*a* can be subjected to forced reciprocating motion under the actions of one or more of the following: the pressure of any working fluid vapor in chamber 58*a* acting on end 56*a* of rod 54*a*; a direct contact force exerted by flange 48*a* pressed against end 56*a* by the combined action of spring 50*a* and direct contact with the curved end of connecting rod 32*a* as transmitted through the body of valve 46*a*; and the force differential generated by a pressure differential applied across piston 62*a* by the pressures conveyed to opposite end faces thereof through pipes 66*a* and 68*a*. Note that pipe 68*a* is always accessed only to the exhaust pressure, whereas pipe 66*a* accesses the pressurized vapor in chamber 58*a* at appropriate times. With specific reference to the geometry illustrated in FIG. 1A, when piston 30*a* is at its top dead center, it will have forced inlet valve rod 54*a* to its leftmost position. A transversely extending pin 70*a* attached to inlet valve rod 54*a*, correspondingly, also will be in its leftmost position, movably contained within a transversely elongated aperture 72*a* formed in a rotatably supported element 74*a* mounted to an adjustably positioned but fixed pin 76*a*.

Pin 76*a* is affixed to an end of a sealed-in element 78 which is adjustably clamped into position within the inlet valve assembly structure by a plurality of interacting pairs of adjustable bolts 80*a* and a sealing end 82*a*. Other means for providing two-dimensional adjustment may also be used effectively. By adjusting bolts 80*a* by opposing pairs, pin 76*a* can be moved closer to or farther away from head plate 60*a*, and by loosening all of bolts 80*a* and adjusting sealing end 82*a* pin 60*a* can be moved in a direction normal to the line of motion of piston 30*a*. Therefore, by proper coaction of bolts 80*a* and sealing end 82*a* the exact location of fixed pin 76*a* can be determined with respect to pin 70*a* on reciprocating inlet valve rod 54*a*. There is thus provided a facility for adjusting the instantaneous position and subsequent movement of rotatably supported element 74*a* within inlet the valve assembly structure in a sealed-in manner. Rotation of element 74*a* about pin 76*a*, due to reciprocating motion of inlet valve rod 54*a*, results in a corresponding to-and-fro motion of an end 84*a* of element 74*a*. This end

84*a* is shaped and sized to be movably but closely contained in an opening 86*a* in a movable valve plate 88*a* that is slidingly held against head plate 60*a*. Movable valve plate 88*a* slidingly held against fixed head plate 60*a*, in essence, constitutes the heart of the inlet valve controlling the flow of incoming vapor into chamber 58*a*.

Movable valve plate 88*a* in its downwardmost position (as illustrated in FIG. 1A) has a plurality of vapor passage openings 90*a* which, in this position, become congruent with a matching set of vapor passage openings 92*a* in fixed end plate 60*a*. Therefore, as illustrated in FIG. 1A, when piston 30*a* is at its TDC, inlet valve rod 54*a* is pushed to its leftmost position, element 74*a* is at its extreme clockwise rotated position and, correspondingly, movable inlet valve plate 88*a* has moved to its lowermost position to put vapor passage openings 90*a* and 92*a* in vapor communication. Under these circumstances, pressurized working fluid vapor is delivered through an inlet vapor pipe 94*a* to an inlet vapor chamber 96*a* within which rotatable element 74*a* and movable valve plate 88*a* operate. This vapor, as indicated generally by the arrow designated IV (representing "incoming vapor") and smaller arrows flowing thereafter, passes through chamber 96*a* and apertures 90*a* and 92*a* to enter chamber 58*a* defined in part by the crown of piston 30*a*, as "incoming vapor". There is, therefore, at this point a force generated by pressurized incoming vapor available to generate reciprocating motion of piston 30*a* in a working stroke away from its TDC to apply a torque on engine crankshaft 26. This vapor pressure holds flange 48*a* of pressure relief valve 46*a* in sealing contact in recess 50*a* of piston 30*a*.

FIGS. 1 and 1A–1C are clearly designated as illustrating the engine in its "running mode". What this term means will now be understood with reference to various other elements illustrated in FIGS. 1A–1C. The cylindrical wall of chamber 58*a* is provided with a small aperture 98*a* close to end plate 60*a* and thus communicated through a pipe 100*a* with a pneumatic mode switch valve body 102*a*, through a small first aperture 104*a* in a cylindrical cavity 106*a* inside body 102*a*.

This cylindrical cavity 106*a* has a second aperture 108*a* through which vapor may communicate via a pipe 110*a* to a second small aperture 112*a* provided a predetermined distance downstroke from the TDC through the engine cylinder wall 24*a*. Cylindrical cavity 106*a* of body 102*a* is closed off at a first end by a plug and accordion-type seal 114*a* that allows sealed-in to-and-fro motion of a rod 116*a* centrally of cylindrical cavity 106*a*. Cylindrical cavity 106*a* also has a smaller diameter coaxial cylindrical extension 118*a* having a diameter larger than the diameter of a pointed end extension of rod 116*a* by a predetermined amount. A third aperture 120*a* is provided in cylindrical cavity 106*a* axially intermediate small apertures 104*a* and 108*a* therein. A narrow passage 122*a* connects aperture 120*a* to a fourth small aperture 124*a* that is located in the wall of cylindrical extension 118*a*. Cylindrical extension 118*a* also communicates at its end through pipe 66*a* with chamber 64*a* in which a cylindrical portion piston 62*a* is slidably movable with attached inlet valve rod 54*a*. A short solid cylinder 117*a* is provided coaxial with rod 116*a* and is of a diameter to very closely and slidingly fit into the cylindrical surface of cylindrical cavity 106*a*.

The second aperture 108*a* is placed closer to the accordion sealed end of body 102*a* so as to avoid compression of vapor when solid piston 117*a* moves toward the right (as seen in FIG. 1A). When piston 117*a* moves leftward (again as seen in FIG. 1A) enough to close off first aperture 104*a* it cuts off communication between chambers 58*a* and 64*a*. Piston 117*a* therefore must be of a length equal to the distance measured from the leftmost side of aperture 104*a* to the rightmost side of aperture 120*a*, so that at any time only one of these two apertures is uncovered by piston 117*a*.

Rod 116*a*, extending from plug and accordion seal 114*a*, has a bent end 126*a* thereat which is movably contained in a transversely elongate aperture 128*a* in a movable arm 130*a*. At its other end, beyond solid cylinder 126*a*, rod 116*a* extends coaxially within small diameter cylindrical extension 118*a* to an extent determined by the position of rod 116*a* as controlled by movement thereof by arm 130*a*. The adjustable amount by which the small diameter cylindrical extension 118*a* receives rod 116*a* is identified by the letter "x". A throttle valve 132*a* is provided in the pipe 66*a* intermediate cylinder chamber 64*a* and small diameter cylindrical extension 118*a*.

Referring now to the details illustrated in FIG. 1A, with particular attention focused on elements in and surrounding pneumatic mode switch valve body 102*a*, and for the present considering only the "running mode" of the engine (beat visualized as a crankshaft speed at which the rotational inertia associated with rotating crankshaft 26*a* readily carries every piston past its TDC) it will be understood that:

(i) high pressure incoming vapor is being admitted into chamber 58*a* to act upon the crown of piston 30*a* and communicates through aperture 98*a*, pipe 100*a*, aperture 104*a*, cylindrical cavity 106*a*, the annular passage defined by coaxial location of a length "x" of rod 116*a* within small diameter cylindrical extension 118*a*, throttle valve 132*a* and pipe 66*a* to chamber 64*a* to act upon the far end face of piston 62*a* coaxially connected with inlet valve rod 54*a;*

(ii) any low pressure vapor present in the annular clearance between the skirt of piston 30*a* and the cylindrical surface 24*a* therearound will communicate through small aperture 112*a*, pipe 110*a* and aperture 108*a* at the plug end of cylindrical cavity 106*a* but, because piston 117*a* blocks off aperture 120*a* cannot communicate past this point to affect the force differential acting on piston 62*a* to influence motion of inlet valve rod 54*a* but the near end face of piston 62*a* is acted upon by a very low pressure applied to chamber 65*a* via pipe 68*a* connected to exhaust vapor conduit 36*a*; and (iii) movable arm 130*a* has moved to a position in which its aperture 128*a* holds bent end 126*a* of rod 116*a* so that the other end thereof projects by a length "x" inside small diameter cylindrical extension 118*a*.

Because of the throttling effect of constricted annular space between rod 116*a* and the somewhat larger small diameter cylindrical extension 118*a*, by moving arm 130*a* it is possible to adjust the length "x" and thus the amount of the impedance imposed in the way of flow of any vapor from chamber 58*a* to chamber 64*a* to influence the rate of opening or closing of the vapor inlet valve assembly. There is thus provided a controlled but variable flow impedance and, as will be discussed more fully hereinafter, the exact location of arm 130*a* is directly related to the mode of operation of the engine (i.e., whether it is in a "start-up mode" or "running mode") and one or more flow parameters, e.g., the rotational speed of crankshaft 26*a*, so that the controlled variable impedance as determined by the length "x" is a means for automatically and controllably throttling the engine during its operation in its "running mode". A user-selected setting on throttle valve 132*a*, by contrast, represents a relatively inflexible but precisely adjustable flow impedance located in pipe 66*a* to, in effect, complement the controlled but readily variable throttling action just described.

Control of the speed at which the engine rotates and the amount of torque produced while doing so are both clearly relatable to the amount of incoming vapor admitted into variable volume chamber 58*a* to act on the crown of piston 30*a*. The communication of this high pressure via aperture 98*a* to chamber 64*a* on the far side of piston 62*a*, with chamber 65*a* at a low condenser pressure, causes rotation of element 74*a* to forcibly move valve plate 88*a* out of vapor communication with chamber 58*a*, and this results in shut-off of any further inflow of high pressure incoming vapor. The amount of working vapor trapped in chamber 58*a* when further inflow ceases determines the amount of enthalpy potentially available for conversion into mechanical work when this charge of vapor expands and forcibly overcomes the resistance of piston 30*a* in its working stroke. At a relatively high engine speed, movement of arm 130*a* will draw the pointed end of rod 116*a* further out of cylindrical extension 118*a*, thereby reducing "x" and the variable flow impedance in the vapor communication between chambers 58*a* and 64*a*. As a result, the inflow of pressurized incoming vapor is terminated quickly and each vapor charge expands rapidly against the piston 30*a*. At relatively slower speeds, the uniflow of vapor lasts longer since the reverse occurs, i.e. , there is a higher variable flow impedance and a slower shut-off of incoming vapor. Note also that the higher the pressure of the incoming vapor, the larger will be the mass of working vapor accepted per charge. The point during the working stroke at which expanded and low enthalpy vapor is exhausted from cylinder 24*a* via apertures 134*a* to exhaust vapor conduit 36*a* is another factor that will determine the rotational speed of the engine, the output torque, and the output power contributable to cylinder 24*a* in the multicylinder uniflow engine. In general, the higher the pressure or temperature of the incoming vapor, the more available energy there will be per charge of incoming vapor in each cylinder chamber.

Consider now another factor related to the pressure of incoming vapor, namely the required sealing shut of the pressure relief valve flange 48*a* into recess 50*a* of piston 30*a*. The stiffness of spring 52*a* of the relief valve must be carefully selected, depending on the particular engine, the selected working fluid and the operational conditions, such that the pressure of the working fluid vapor in chamber 58*a* throughout the working stroke is more than adequate to maintain flange 48*a* in sealing contact seated inside recess 50*a* in the crown of piston 30*a*. In other words, since the working fluid vapor is expanding to produce useful mechanical work by resisted motion of piston 30*a*, by intention and design no significant leakage thereof is permitted past relief valve flange 48*a* in the crown of piston 30*a* during the working stroke.

Each piston goes through a complete to-and-fro motion corresponding to 360° of rotation of crankshaft 26. With the engine in its "running mode", it is, therefore, convenient now to switch attention to the piston 30*c* in assembly 24*c* which a fraction of the rotation of crankshaft 26*a* earlier had received a charge of working fluid vapor in its chamber 58*c* and is expanding the same in a working stroke.

Attention therefore must now be focused on FIG. 1C to appreciate what will happen to piston 30*a* as it moves from its TDC to perform a working stroke. We can, at this point, regard FIG. 1C as presenting a view of a piston that has performed that part of its working stroke which corresponds to 120° rotation of the crankshaft from its TDC position. As seen in FIG. 1C, piston 30*c* is still being acted upon by a useful force from the charge of expanding working fluid vapor in chamber 58*c*. L-section seal 42*c* is still covering small aperture 112*c*; the pressure of the working fluid vapor in chamber 58*c* is still sufficient to maintain flange 48*c* in sealing contact inside recess 50*c* in the crown of piston 30*c*; movable inlet valve plate 88*c* still has its vapor apertures 90*c* out of congruence with corresponding apertures 92*c* in fixed end plate 60*c*; inlet valve rod 54*c* is extending to its maximum into chamber 58*c* and piston 62*c* at the end of inlet valve rod 54*c* is at its position closest to the axis of rotation of the engine crankshaft, i.e., the position at which the "inlet valve" is closed. Piston 30*c* is still in the course of completing its working stroke and, therefore, due to the action of still expanding working fluid vapor in chamber 58*c* is exerting a useful torque on crank 28 and is acting to move piston 30*a* away from its TDC position to begin its next working stroke.

It must be appreciated fully that piston 30*a* will actually have to move from its TDC and commence its working stroke with a fresh high pressure charge of incoming vapor acting on it for the preceding piston 30*c* ("preceding" only in the sense that it had its working stroke earlier) begins to exhaust its charge of vapor in chamber 58*c* by moving past exhaust apertures 134*c* immediately provided all around cylindrical surface 24*c* to communicate with exhaust vapor conduit 36*c*. It should also be noted that exhaust conduit 36*c* communicates through a small aperture 136*c* therein via pipe 68*c* with chamber 65*c* so that a low pressure comparable to the condenser pressure is constantly applied during engine operation to that face of piston 62*c* which is closest to fixed head plate 60*c* of cylinder assembly 24*c*. Also, the constant availability of a low pressure to chamber 65*c* and the near side of piston 62*c* ensures removal of any condensation formed there and of any pressurized vapor that leaks past piston 62*c* from chamber 64*c*.

Note that, in the meantime, the still expanding vapor charge in chamber 58*c* is communicating, as was described in detail with reference to FIG. 1A, with the far or outer face of piston 62*c* so that the combined effect of the low pressure applied to the inner face of piston 62*c* and the relatively higher pressure applied to the outer face of piston 62*c* has the effect of holding rotatable element 74*c* so as to maintain inlet valve plate 68*c* in a "closed" position. As will be appreciated, as the crankshaft rotates further, piston 30*c* will move toward the rotational axis of the engine so as to move inboard of apertures 134*c* and chamber 58*c* will communicate with the very low condenser pressure conveyed by conduit 36*c* to exhaust a substantial portion of the expanded vapor charge, for subsequent condensation thereof for recyclical use. An piston 30*c* does this, piston 30*a* meanwhile has already commenced its power stroke and will be contributing its force at the crank radius to continue delivery of torque and power to rotate engine crankshaft 26.

In "running mode" operation, as best understood with reference to FIGS. 1A, 1C and 1, piston 30*c* has not passed aperture 112*c* by the time piston 30*a* reaches its TDC. A very short time later, when piston 30*a* is 10° past TDC in its working stroke, piston 30*c* will pass the aperture 112*c* in its cylinder 24*c*. The spacing apart of apertures 98 and 112 in each of the cylinders must, therefore, be very carefully selected to ensure such operation of rotationally sequential pistons to ensure correct "start-up", "mode change" and "running mode" operation after self-starting of the engine upon availability thereto of working fluid vapor at a suitable condition.

Attention may now be focused to what is going on at this instant in cylinder assembly B. Again, regarding this an a virtual snapshot of piston 30*b* in the course of its exhaust stroke, the benefits provided by pressure relief valve 46 in each of pistons 30 can be appreciated.

Referring now to FIG. 1B, it is seen that piston 30*b* is moved away from its BDC toward its TDC to such an extent that its lead piston ring 42*b* has already blocked off small aperture 112*b*. Note that movable inlet valve plate 88*b* has its apertures 90*b* out of congruence with apertures 92*b* of fixed end plate 60*b*, i.e., whatever residue of working fluid vapor remains in chamber 58*b* (albeit virtually at the low condenser pressure of the system) remains, and would be compressed as piston 30*b* moves toward its TDC if the crown of piston 30*b* were an unbroken surface. According to the present invention, however, as soon as the pressure in chamber 58*b* drops below a predetermined low value, spring 52*b* forces relief valve body 46*b* and its flange 48*b* outward of piston 30*b* and into chamber 58*b*. As indicated in FIG. 1B by the curved arrows behind flange 48*b*, this residual vapor still remaining in chamber 58*b* passes around relief valve body 46*b* and into the central cavity within main body 22. Because this flow is of low pressure vapor it is not sufficient, by itself, even with the Bernoulli effect, to overcome the force of spring 52*b* to seal shut flange 48*b* into recess 50*b*. This residual vapor which thus escapes from chamber 58*b* moves through the finite annular gap between the wall 24*b* and the cylindrical surface of the skirt of piston 30*b* to apertures 134*b* in the low pressure region communicating with the condenser of the closed loop system. In other words, as any one of the pistons approaches its TDC during its return or exhaust stroke, instead of the residual low pressure vapor being compressed, and thereby exerting a resistance to rotation interfering with the efficient operation of the engine, most of this vapor is enabled to escape to the condenser very easily.

Note, however, that when piston 30*b* moves close enough to its TDC the central portion of flange 48*b* will make contact with end 56*b* of valve rod 54*b*. By appropriate selection of the stiffness of spring 52*b* and the inertial mass of the relief valve 46*b*, this contact can be utilized to place flange 48*b* in sealing contact inside recess 50*b* of piston 30*b* even before inlet valve rod 54*b* is moved substantially from its inlet valve closed position. Consequently, whatever residual vapor remains in chamber 58*b* when flange 48*b* is in sealing contact with the crown of piston 30*b* will exert a cushioning effect on piston 30*b*. The elasticity of spring 52*b* also helps cushion the closure of flange 48*b* to recess 50*b* of piston 30*b* and the impact between flange 48*b* and valve rod end 56*b*. An the crankshaft 26 continues to rotate and piston 30*b* approaches and reaches its TDC, inlet valve rod 54*b* will be pushed out of chamber 58*b* to the extent necessary to move rotatable element 74*b* so as to admit entry of a fresh charge of high pressure incoming vapor into chamber 58*b*. At this point, cylinder assembly B will have reached the status best understood with reference to FIG. 1A.

The immediately preceding paragraphs provide a detailed description of the working and exhaust strokes, in the "running mode" of the self-starting multicylinder uniflow engine, according to a preferred embodiment of this invention.

It now remains to be described how and why this engine will automatically start from a dead stop regardless of the position of the engine crankshaft and why and how it will operate through a start-up mode when it has to overcome the inertia of the movable parts of the system, as well as how and when it will experience a mode change from the start-up mode to the running mode, and how it will continue in its running mode until it reaches its correctly throttled running mode operation. These descriptions will now be provided.

In order to understand the manner in which the uniflow engine of this invention begins rotation of the crankshaft from a total stop and proceeds from a start-up mode to a running mode, it is helpful to refer to FIGS. 2 and 3. FIG. 2, in partial vertical section illustrates various components related to cylinder assembly A wherein the elements inside pneumatic mode switch valve body 102*a* are in their "start-up mode" positions. Specifically, rod 116*a* is far enough to the left in FIG. 2 so that cylinder 117*a* is blocking opening 104*a*, thereby preventing communication between any high pressure working fluid vapor contained in chamber 58*a* through pipe 66*a* to exert a force on the outer face of cylinder 62*a*. This is accomplished by rotation of L-bracket 202*a* about fixed pin 204*a* so that arm 130*a* is driven close to the mode switch valve body 102*a*. Rotation of L-bracket 202*a* is regulated by the application of a vertical force V which provides a turning torque T on outer pin 204*a*. The manner in which this vertical force V is generated and applied to regulate a mode change will be discussed hereinafter. Note that for each cylinder of the engine there is a separate L-bracket 202 having a downwardly depending arm 130 and a substantially horizontal arm 206, these being simultaneously rotatable about corresponding fixed pins 204 held in brackets 208 supported by uprights 210. Horizontal arms 206 have at their distal ends horizontally elongate apertures 112 within which are slidably engaged pins 214 attached to vertical elements 216 to which the vertical force V is applied by a movable element 218 that is commonly connected to all three cylinder assemblies.

Also illustrated in FIGS. 2 and 3 are a pair of flywheels 220 preferably positioned one on each side of common crank 28 to which connecting rods 32*a*–32*c* are rotatably connected. A hollow base portion 222 of the engine body serves as a containment means for a quantity of lubricant 224 that is made available to the various sliding and rotating surfaces by splashing generated by rotation of splash vanes 226. A combined thrust and roller bearing 228 supports the lowermost end of the engine crankshaft 26. A stainless steel sealing membrane 230, to the lower and upper central surfaces of which are applied non-rotating thrust pads 232 and 234, respectively, seals in the crank and other attached components. Rotatively engaging thrust pads 232 and 234, respectively, are bearing race 236 (firmly attached to a driving magnetic clutch disk 238) and a rotating bearing race 240 (firmly attached to a driven magnetic clutch disk 242). Bearing race 240 is mounted at the end of driven or output shaft 244 which, in the embodiment illustrated in FIG. 2, may be exposed to the ambient atmosphere.

In other words, engine crankshaft 26 drives driving magnetic clutch disk 238 within a sealed environment that may be occupied only by working fluid in its various physical states and the lubricant, at a predetermined pressure under any temperature conditions, and the driven shaft 244 is sealingly separated therefrom by the stainless steel membrane 230. The physical gaps between the fixed surfaces of stainless steel membrane 230 and the closely adjacent rotatable magnetic clutch disks 238 and 242 are kept as small as practicable. Since stainless steel does not distort magnetic lines of force, magnetic clutch disks 238 and 242 normally provide a noncontacting and highly efficient, low-friction sealed drive from the engine crankshaft 26 to the driven shaft 244.

Referring now to FIG. 3, a conventional V-belt may be provided on driven shaft 244 to drive equipment that is to be powered by the engine. Driven shaft 244 is most conveniently supported in bearings 248 and 250 respectively positioned close to its lower and upper ends. These bearings are supported by inward extensions attached to fixed upright elements 210 of which at least one is provided per cylinder.

Near the top end of driven shaft 244 is provided a boss 252 rotatable with the driven shaft, and this boss provides pivotal support for preferably two diametrically opposed pivots 254 to which are pivotably attached rotatable arms 256 each supporting a weight 258. Arms 256 are also provided with pins 260 pivotally connected to links 262 at their lower ends to pins 264 attached to a rotatable sleeve 266 rotatable with the driven shaft 244. Sleeve 266 through bearing 272 engages element 218 so that the latter is nonrotatably movable along the engine axis of rotation within slide grooves 268 provided in upright members 210. It should be noted that the upper end of crankshaft 26 is rotatably supported within the main body 22 by a sealed-in journal bearing 270.

What follows initiation of rotation of crankshaft 26, in terms of the various elements described in the immediately preceding paragraphs, will now be described.

For the present, the immediately following description relates only to what happens when the crankshaft of the engine starts to turn from a total stop, a separate description being provided thereafter of the design factors that ensure automatic start-up of the engine from a total stop regardless of the position in which the engine crankshaft 26 ends when the engine ceases operation.

When crankshaft 26 starts to turn, the coaction of driving and driven magnetic clutch disks 238 and 242 transmits a torque that becomes available at driven shaft 244 as an output torque. Even if there is a small temporary relative slip between the driving and driven clutch disks 238 and 242, under most normal operating conditions driven shaft 244 will promptly commence rotation in the same direction as crankshaft 26. In the extreme case where driven shaft 244 is held fixed, i.e., nonrotatable, by attached equipment, the situation is clearly abnormal. As will be readily understood by persons skilled in the mechanical arts, upon rotation of driven shaft 244 centrifugal forces corresponding to the angular speed of rotation of output shaft 244 act radially outward on governor weights 258 which may conveniently be formed as compact spheres made of a relatively heavy metal. The result of such radially outwardly directed centrifugal forces acting on each of the governor weights 258 is to cause rotation of connecting arms 256 about pivots 254, with the direct consequence of lifting rotatable sleeve 266 upward due to pivotable connections between arms 256 and sleeve 266 by links 262 pivoted between and at pins 260 and 264. Since the centrifugal force depends on the square of the rotational speed (regardless of the direction of rotation), for a particular engine speed there will be a corresponding position taken up by rotating governor weights 258 at which the downward force of gravity and any downward pull by the attached parts balances the effect of the centrifugal force. Sleeve 266 moves up commensurately to a position of dynamic balance among such forces and, through a bearing 272, rotates with driven shaft 244 while transmitting an upward motion to movable element 218 to nonrotatably slide it upward or downward in guide grooves 268.

An is clear from a careful review of FIG. 3, because each of the connecting rods at the crank requires a finite space, each of the three cylinders has its axis at a different location with respect to the axis of rotation of both crankshaft 26 and driven shaft 244. For this reason, downwardly depending upright elements 216 for each individual cylinder will have a different length in order that the L-brackets 202 for all three of the cylinders are identical. Identical L-brackets 202 are, thus, positioned at different heights on pivots 204 supported by transversely extending brackets 208 attached to upright elements 210. Upon upward or downward motion of sleeve 266, there will be a corresponding upward or downward motion of movable element 218 and, thereby, the exertion of a force V communicated by elements 216 to L-brackets 202 to rotate the same about their respective supports 204. Due to such a rotation of each of the L-brackets 202 about its pivot 204, vertically elongate apertures 128 at the lower ends of corresponding arms 130 will move radially inward or outward with respect to the engine axis of rotation. This, an was earlier explained in detail with respect to FIG. 1A, will move rods 116 and solid pistons 117 to influence the manner in which various inlet valve rods 54 regulate inflow of working fluid vapor through the inlet valves to provide appropriate charges of the incoming vapor to the various cylinders.

In summary, when the engine is stopped and driven shaft 244 is at rest, and the weights 258 are at their lowest position, sleeve 266 is at its lowest position, and vertically elongate apertures 128 in arms 130 of L-brackets 202 are at their radially outermost positions. But, as the output speed of driven shaft 244 increases, vertical elongate apertures 128 move radially inward toward the engine axis of rotation and will draw out rods 116 from their radially innermost positions in pneumatic mode switch valve body 102 mounted to each of cylinder assemblies 24.

In the earlier discussion of FIG. 1A it was pointed out that the extent "x" to which the pointed end of rod 116 is projected into small diameter cylindrical extension 118 determines the flow variable impedance provided to any communication between high pressure working fluid vapor in chamber 58 of each cylinder and chamber 64 where the communicated pressure would act on piston 62 to drive inlet valve rod 54. The timing of this, affected by "x", determines the amount of high pressure working fluid vapor admitted to chamber 58 to generate a useful work output by acting on corresponding piston 30. It may be noted that rod 116 need not have the same diameter on both sides of piston 117. What is important is the difference in diameters between the pointed end portion of rod 116 and the diameter of cylindrical extension 118 into which the former projects by a length "x". Recall also that predetermined control may be exercised on the total flow impedance in pipe 66 by adjustment of throttle valve 132, of which one is provided for each of the cylinders. Thus, by selecting an appropriate setting for throttle valve 132 a user can set an upper limit on the flow impedance provided in pipe 66, i.e., the total flow impedance will be determined by throttle valve 132 even if "X" is reduced to zero by pulling out rod 116 far enough so that its pointed end is located within cylindrical cavity 106 only.

Figure 4:
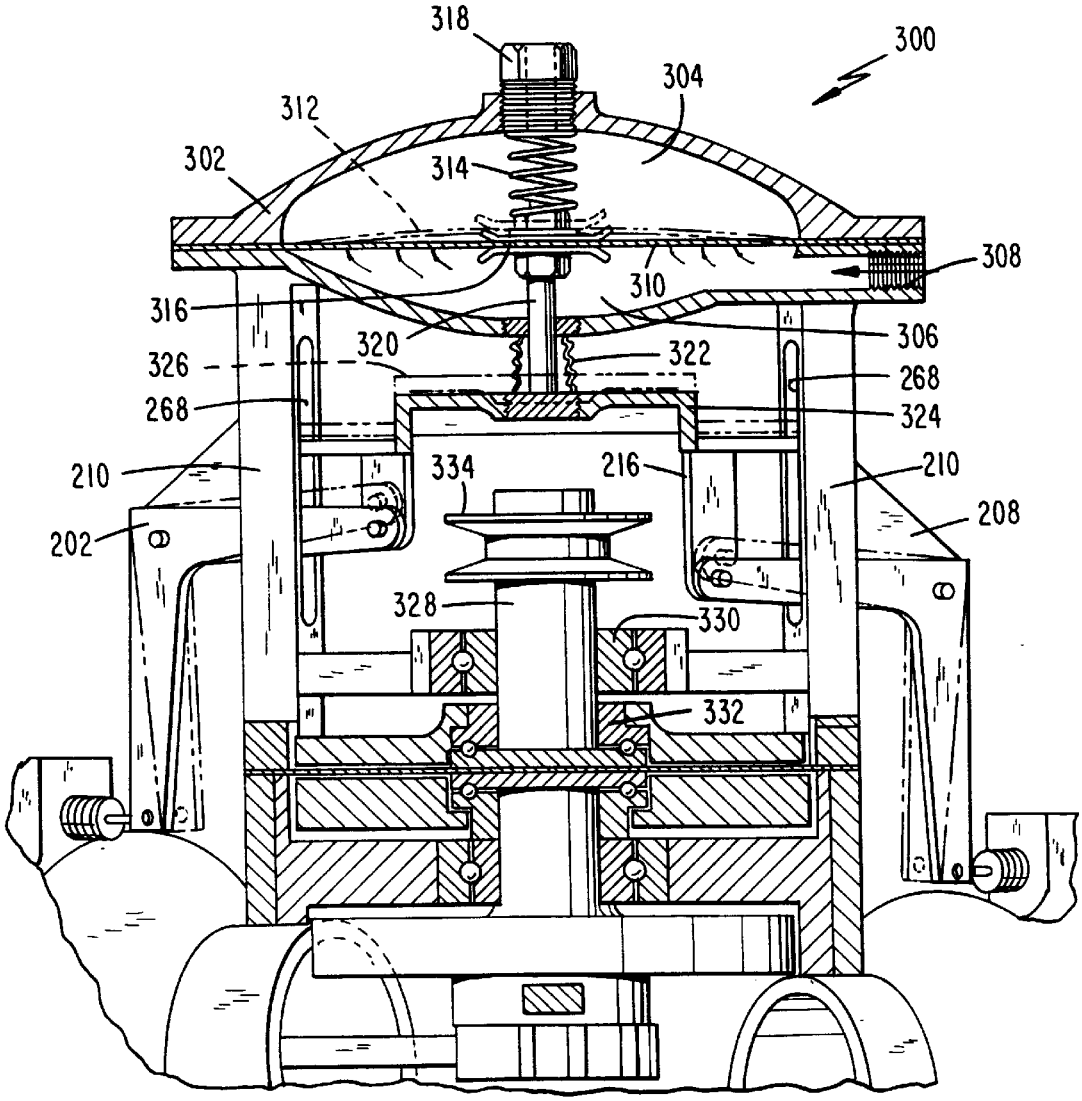
FIG. 4 is a partial vertical cross-sectional view illustrating a sealing component and a rotation-free pressure-responsive mode-change control in another preferred embodiment.

A first alternative embodiment to effect the to-and-fro motion of arms 116 in each of the pneumatic mode switch valve bodies without employing rotating elements is illustrated in FIG. 4. As will be appreciated by persons skilled in the mechanical arts, the inclusion of relatively large rotating masses inherently introduces the possibility of mechanical unbalance, vibration, resonance and possibly the physical destruction of one or more elements. Particularly for units to be utilized with a minimum of human attention for long periods of time in remote areas, it may be desirable to replace the rotating weights of the previously described embodiment by an alternative structure 300, beat seen in FIG. 4, in which upright elements 210 support a two-compartmented pressure chamber 302 that has an upper compartment 304 open to the atmosphere and a lower compartment 306 in direct communication with a source of available high pressure working fluid vapor, e.g., by connection to a pipe at a threaded opening 308. Open chamber 304 and pressurizable chamber 306 are separated by a flexible diaphragm 310 which, in its unflexed state, stretches out flat and, when subjected to high pressure vapor in chamber 306, takes on an upwardly flexed position 312 such that its center has moved upward by a predetermined amount. Control of the amount of such a deflection is provided by pressure exerted by a compression spring 314 pressing down on washer assembly 316 at the center of diaphragm 310. The upper end of spring 314 presses against the bottom surface of bolt 318 threaded into the center of an upper wall of chamber 304. Therefore, by adjustably screwing-in bolt 318 a corresponding force can be exerted through spring 314 on diaphragm 310 to thereby limit the amount by which it will distort and deflect when subjected to a particular working fluid vapor pressure in chamber 306. Bolt 318 has a central through aperture to enable open chamber 304 to freely communicate with the ambient atmosphere.

Washer assembly 316 of diaphragm 310 has downwardly depending therefrom a rod 320, the lower end of which is sealed by an accordion seal 322 to the top of a load transferring cross-member 324 for which an elevated position is indicated by broken lines as 326. Note that cross-member 324 is nonrotatably guided by grooves 268 provided in upright members 210. Cross-member 324 has attached to it downwardly depending upright elements 216, each sized as needed for particular cylinders in a manner described hereinbefore, which are pinned to rotate L-brackets 202 in response to a pressure-induced deflection of diaphragm 310.

In the embodiment that is illustrated in FIG. 4 it is therefore the attainment of a predetermined value of working fluid vapor that causes rotation of L-brackets 202 and, hence, pulling out of rods 116 from the various pneumatic mode switch valve assembly bodies 102. This embodiment has a much smaller rotational inertia at the driven end of the engine, this being limited solely to driven shaft 328 supported in bearings 330 and in bearing race 332. Pulley 334 may be provided at a distal end of driven shaft 328 to transmit power to other equipment. A second alternative embodiment, also without major rotating elements, as best understood with reference to FIG. 10, utilizes a thermostatic temperature sensitive force-applying element of known type in chamber 302, to move its lower end upwardly to pull on depending rod 320 solely in response to the temperature of a small flow of working fluid vapor past it. In this embodiment, bolt 318 and spring 314 are replaced by a thermostatic element 400 which has a vertical temperature-responsive element 402 of variable length that increases its length in response to an increase in its temperature. Thermostatic element 400 is firmly connected to the inside surface of the top of chamber 302 which, in this embodiment, does not communicate with the atmosphere. Inside element 402 is supported at its bottom. A small flow of working fluid vapor, once some is generated at the system boiler element (not shown), is flowed through chamber 302. When its temperature attains a predetermined value, the upper end of thermostatic element 402 will extend upward and will pull rod 320, and hence cross-member 324, upward to thereby rotate L-brackets 202 to obtain the same results as were previously described. In short, the embodiment of FIG. 10 provides a temperature-responsive way to self start and control the engine of this invention in a manner otherwise very similar to that of the first embodiment that utilizes speed-sensitive rotating weights.

Figure 10:
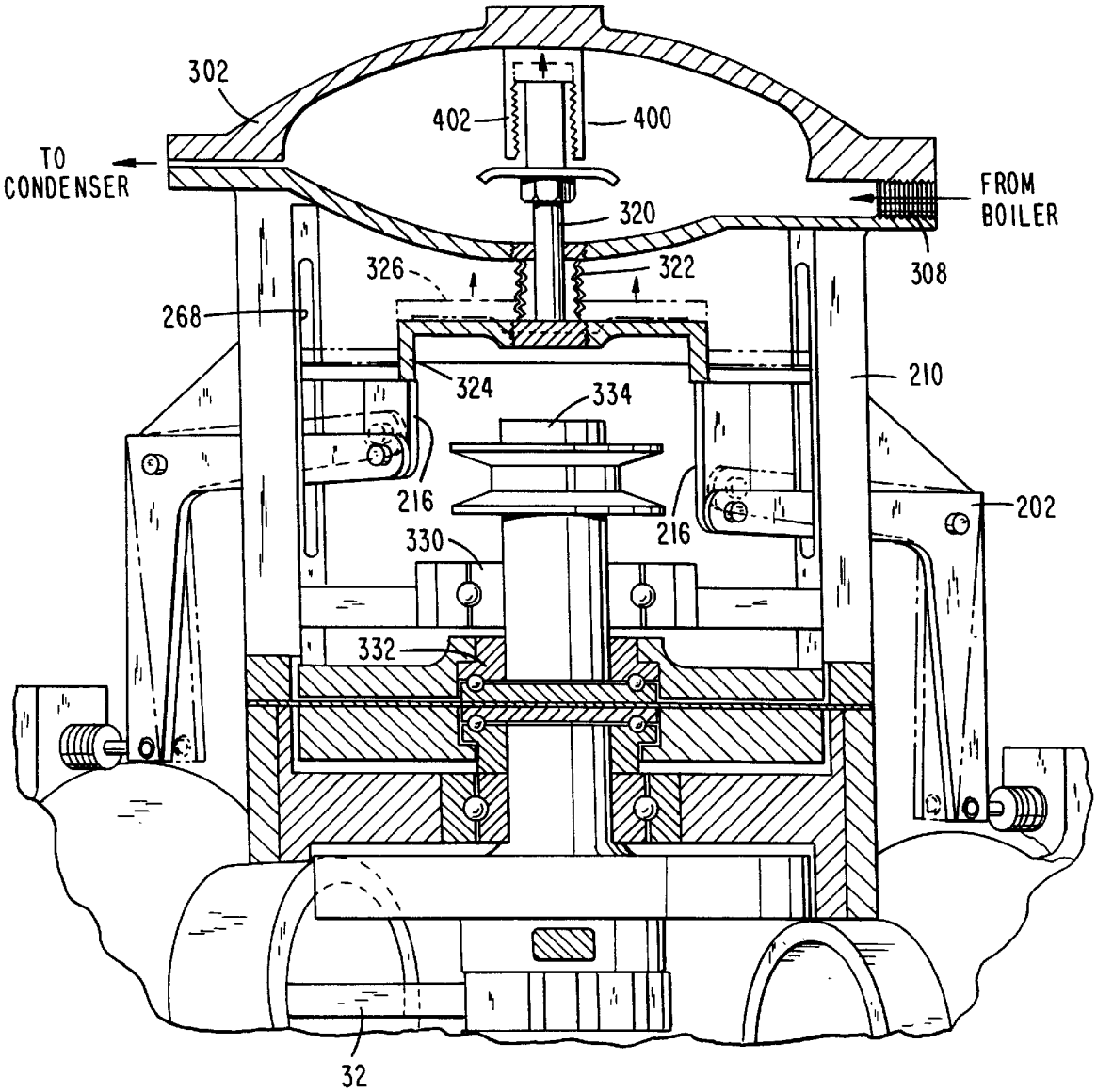
FIG. 10 is a partial vertical cross-sectional view illustrating a sealing component and a rotation-free temperature-responsive mode-change control in yet another preferred embodiment.
Figure 11:
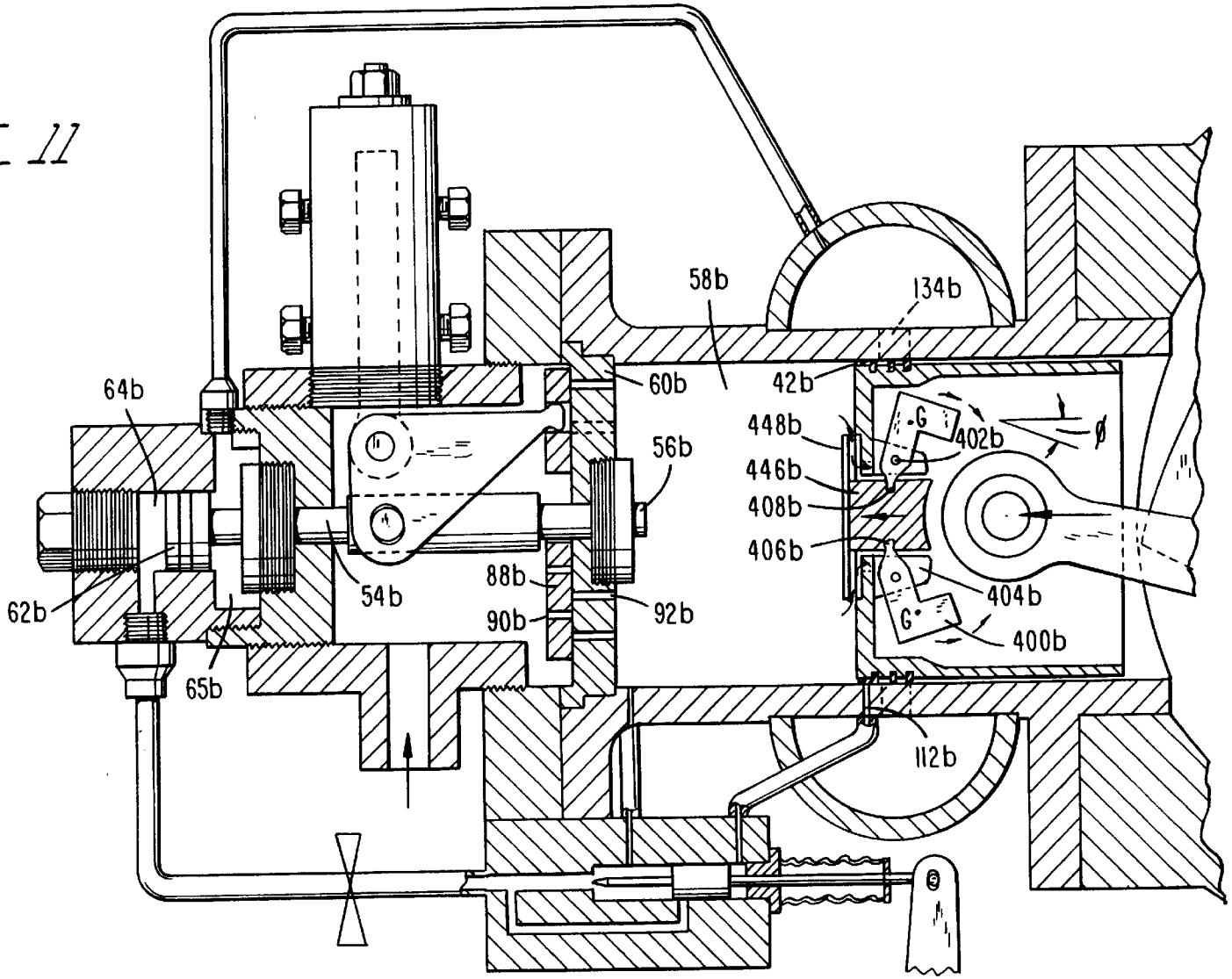

For purposes of future reference, the embodiment utilizing rotating linkage as illustrated in FIG. 3 will be referred to as the "rotary embodiment", the embodiment illustrated in FIG. 4 as the "pressure embodiment" and the embodiment illustrated in FIG. 10 as the "temperature embodiment". In each case, it is an operational parameter of interest to the user that regulates operation of the engine, i.e., rotational speed of the output shaft and the sustained pressure or temperature at which working fluid vapor continues to be available from a supply source in the rotary, pressure and temperature embodiments, respectively. In each case, there is an upward motion of the sliding element 324 that causes controlled rotation of an L-bracket 302 at each cylinder to reposition rod 116 with cylinder 117 to selectively block off certain passages in pneumatic mode switch valve body 102. This is how the mode change control is exercised in the principal embodiments of the present invention.

Other alternative structure will no doubt be contemplated to achieve the same action and purpose, i.e., to generate a movement in response to an operational engine parameter attaining a certain value in order to effect a mode change when appropriate. Thus, mechanical linkages could be provided to directly and mechanically control the position of inlet valve rod 54, to thereby regulate the amount of high pressure working fluid vapor received in each cylinder to produce useful work per working stroke. These devices could include, inter alia, cables, springs, and the like. The principal purpose to be served in each case, as will now be discussed, is to ensure that the engine can start from a complete stop regardless of the angle at which the crankshaft has come to rest with respect to any of the cylinders and to ensure that the start-up mode leads smoothly and reliably to a normal running mode.

Figure 5:
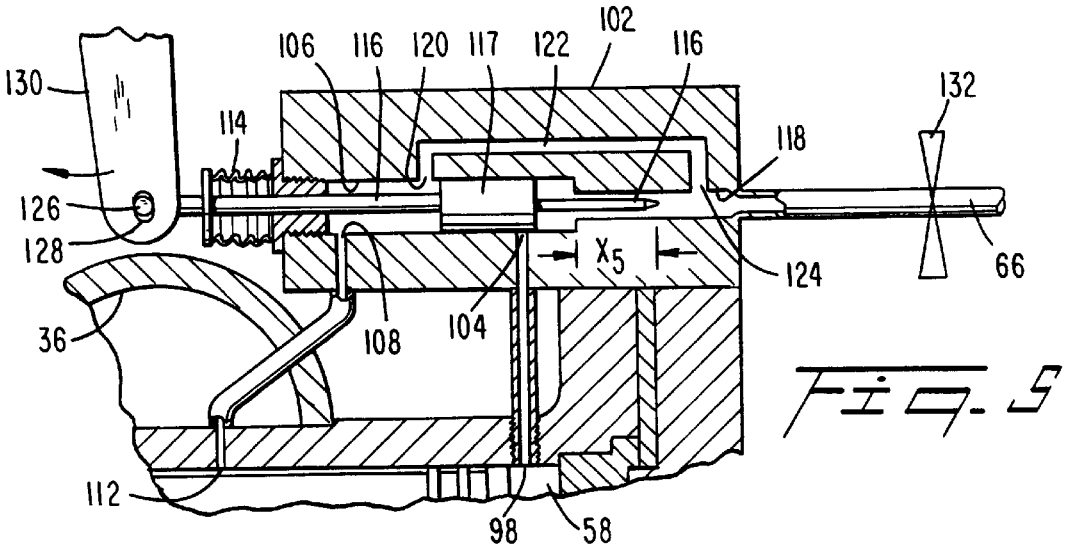
FIG. 5 is a longitudinal cross-sectional view through a portion of the pneumatic mode-change control valve assembly, in the "start-up mode".
Figure 6:
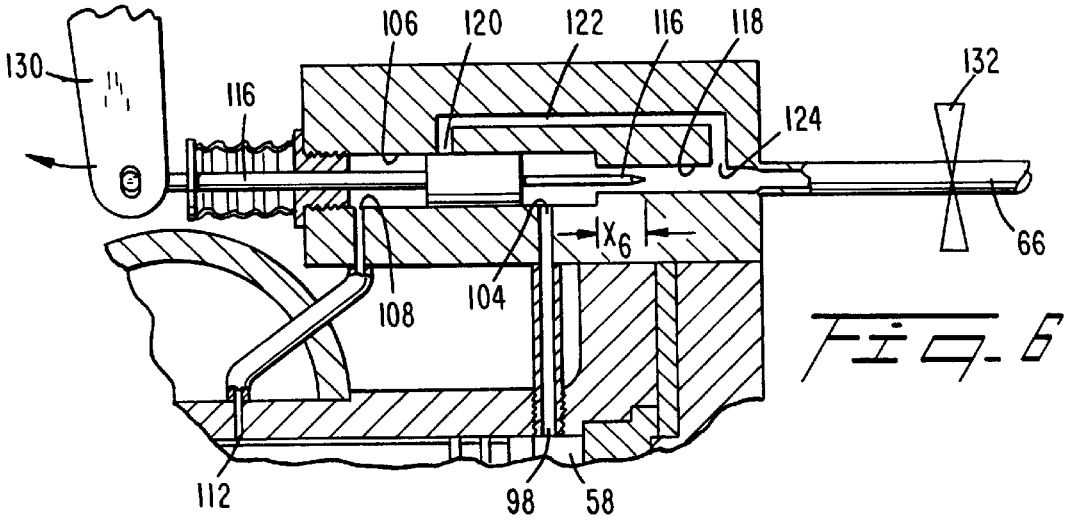
FIG. 6 is a longitudinal cross-sectional view through a portion of the pneumatic mode-change control valve assembly, in a throttled "running mode".
Figure 7:
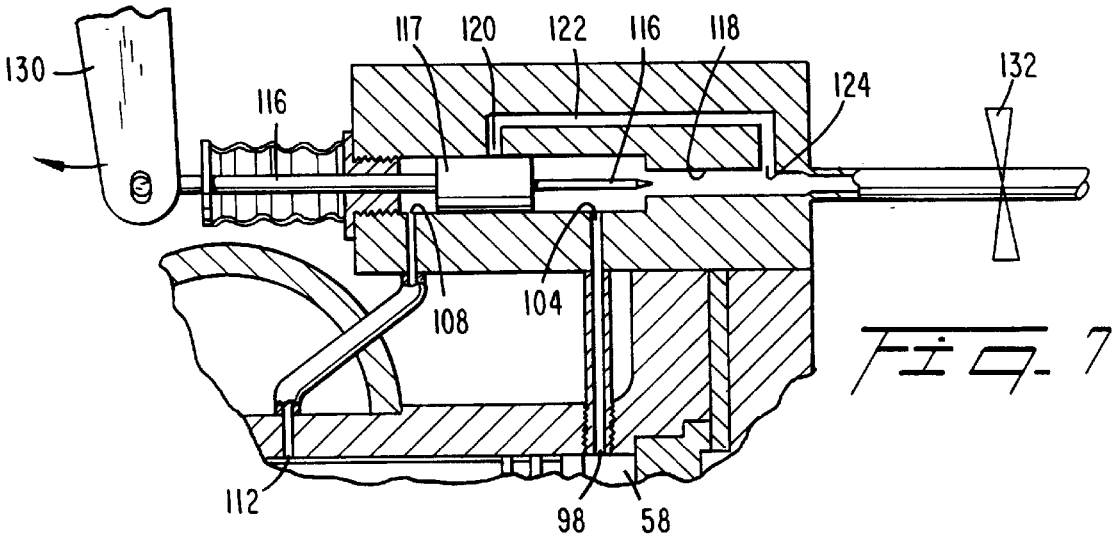
FIG. 7 is a longitudinal cross-sectional view through a portion of the pneumatic mode-change control valve assmbly, in the "running mode".

Referring now to FIGS. 5, 6 and 7, it is seen that in each case a cross-sectional view is presented of a pneumatic mode switch valve body 102 and that the differences among these figures are in the relative locations of rod 116 and associated solid piston 117. Note that the structure illustrated in FIGS. 5–7 is shown turned 180° as compared to the same structure in FIGS. 1A and 1B, for example.

FIG. 5 shows rod 116 and solid piston 117 (together referred to as the "mode switch valve" hereinafter) in the "start-up mode" position. This is characterized by the fact that cylinder 117 blocks aperture 104 through which communication may be had with the high pressure working fluid vapor in chamber 58. Also, in this position, the forward and of rod 116 extends into small diameter cylindrical extension 118 by a distance identified as "$x_5$" although, since now there can be no fluid flow from chamber 58 there is at this time no throttling function being performed in relation to this distance "$x_5$". In fact, at this time, the only vapor pressure communication made possible by the mode change valve is through aperture 112, aperture 108, cylindrical cavity 106, aperture 120, passage 122, aperture 124, throttle valve 132 and pipe 66 leading to chamber 64 at the far end of piston 62 to influence inlet valve rod 54. The pressure thus applicable to the far end face of piston 62 is only a low pressure or condenser pressure and the other side of piston 62 also communicates with exhaust conduit 36 that is also at the same condenser pressure. There is thus no not pressure differential on piston 62 until movement of piston 30 past aperture 112 allows vapor at higher than condenser pressure to communicate with piston 62 to act on valve rod 54 and this, in fact, is true for all the pneumatic mode switch valve bodies 102, one on each cylinder.

In other words, during the "start-up mode", arm 130 at its rightmost position, in FIGS. 5–7, allows no utilization of the high pressure working fluid vapor, if any is available in chamber 56, to move any of valve control rods 54 in any of the cylinders until aperture 112 is uncovered and accesses vapor in chamber 58. This being the case, if a particular piston, e.g., piston 30*a*, happens to be at its TDC, because it will have pushed its corresponding inlet valve rod 54 out of chamber 58, it will be available to receive high pressure working fluid vapor if any is available. See FIG. 1A for a clear understanding of this. It must be remembered that having one of the pistons at its TDC is the most extreme condition since that piston, technically, cannot generate any torque to produce or promote rotation of the crankshaft from a total stop. When piston 30*a* is in a position to have completed part of its working stroke, i.e., when piston 30*a* moves away from end 56*a* of its inlet valve rod 54*a*, then high pressure working fluid vapor would continue to pour into chamber 58*a* to promote rotation. It should be fully appreciated that the mechanism for controlling the inlet valve according to this invention utilizes no springs, no electrical or magnetic devices, and no gravitational effects whatsoever. Therefore, since there is no such force acting on piston 62*a*, the inlet valve will remain open after piston 30*a* has started its working stroke until it passes aperture 112*a*.

Referring now to FIG. 6, it is seen that the mode change valve has been moved by arm 130 more to the left in this figure, i.e., 116 has been withdrawn somewhat from body 102, so that solid cylinder 117 is now blocking aperture 120 but permits communication between chamber 58, through aperture 98, aperture 104, cylinder 106, partially throttled small diameter cylindrical extension 118 and user-set throttle valve 132, via pipe 66*a* to chamber 64*a*. Note that the forward end of rod 116 in FIG. 6 projects into small diameter cylindrical extension 118 by an amount "$x_6$" which is smaller than distance "$x_5$" in FIG. 5. However, this distance "$x_6$" actually does reflect a throttling flow impedance being imposed in addition to that which is available by the user's setting of valve 132. The mode change valve at this time has shifted to the "running mode" and high pressure working fluid vapor from chamber 58 can act on the outside face of piston 62 to push end 56 of inlet valve rod 54 into chamber 58, in the meantime moving inlet valve 88 out of congruence with fixed end plate 92 to cut off any further inflow of high pressure working fluid vapor into chamber 56. Therefore, only that quantity which had entered chamber 58 by this time remains in chamber 58 and is free to expand against piston 30 to produce useful work.

As persons skilled in the thermodynamic arts will appreciate, such an expansion of a relatively small amount of high pressure working fluid vapor would generate a smaller net amount of work output per working stroke than if the inflow of high pressure working fluid vapor were to fill the entire volume swept by the piston 30, but is thermodynamically more efficient. In other words, in the "running mode" a predetermined amount of high pressure working fluid vapor is admitted to each of the cylinders and thereafter expands to move the corresponding piston. By contrast, in the "start-up mode" and as discussed with reference to FIG. 5, there is no restoring force generated by vapor pressure to move inlet valve 54 to shut off inflow of high pressure working fluid vapor which, therefore, continues to enter for almost the entire working stroke. But because the incoming vapor is at the highest available pressure throughout the working stroke, such a start-up mode operation is most effective in getting the crankshaft turning from a stop.

Referring now to FIG. 7, it is seen that arm 130 has moved even further to the left than was the case in FIG. 6 and the pointed end of rod 116 has entirely moved out of the small diameter cylindrical extension 118. Here, as in FIG. 6, high pressure working fluid vapor from chamber 58 is available to act on the far face of piston 62 to shut off flow of high pressure incoming vapor to chamber 58. Thus, FIG. 7 represents a situation where there is virtually no flow impedance due to interjection of the end portion of rod 116 into small diameter cylindrical extension 118 and hence fluid flow into chamber 58 is effected even more promptly than was the case in the situation illustrated in FIG. 6. Since further moving-out of arm 130 represents rotation of the corresponding L-bracket such that a rotary embodiment rotating governor weights are even further out (i.e., the engine is turning at high speed) or in the pressure embodiment of FIG. 4, diaphragm 310 has been lifted relatively high (i.e., the source of working fluid vapor is providing it at a relatively high pressure and thus at a relatively high specific enthalpy and density for a given temperature) the entire operation including admission and cut-off of inlet fluid vapor flow is fast, or at least faster than for the circumstances illustrated in FIG. 6. The only flow impedance in pipe 66 in the situation illustrated in FIG. 7 is from throttle valve 132. In other words, by the user's setting of valve 132, when the engine speed is high, the mode change valve ceases to have any control and only user-set valve 132 determines the operational speed.

It remains now to describe how the engine starts from a complete stop.

It should be remembered that the three cylinders are distributed uniformly 120° apart around the engine rotation axis.

Consider the three embodiments discussed hitherto for effecting the changeover from a "start-up mode", beginning at zero crankshaft speed to the "running mode" at a predetermined mode change rotational speed. The rotary embodiment requires that the crankshaft attain mode change rotational speed for L-brackets 202 to be rotated by the application of vertical force V to effect the mode change. For practical purposes, slip between the engine crankshaft and the driven shaft in the rotary embodiment is small and practically inconsequential. In this embodiment, therefore, it naturally follows that if the supply of working fluid vapor is reduced, e.g., by the onset of darkness where solar energy is the source of energy for generating working fluid vapor, the engine rotational speed will drop until it falls below the mode change speed and, at this moment, L-brackets 202 will rotate about pins 204 to put the mode change valve into a start-up position. In other words, it is inherent in the design of the rotary embodiment that the engine automatically places itself in the "start-up mode" as it slows down before it cams to a stop and this mode is characterized by the fact that the engine, when it comes to a stop, will have all of its working fluid vapor inlet valves wide open. Exactly the same result will be obtained in the pressure and temperature embodiments, because when the supply of working fluid vapor falls below a predetermined pressure or temperature level L-brackets 202 will no longer be provided with a sufficient force V to maintain the "running mode" operation of the engine. The mode change valves will therefore be automatically placed in the "start-up mode" position if the pressure of the available working fluid vapor drops below a predetermined value, e.g., at the onset of darkness cutting off the supply of solar energy to generate the working fluid vapor at a sufficiently high pressure or temperature. Therefore, with all three embodiments, all the inlet valves of the engine cylinders will be put in a wide open position so long as the respective pistons are in their working strokes by the time the crankshaft 26 comes to a stop.

Referring again to FIG. 1A, it will be seen that aperture 112*a* will be passed by the L-section ring 42*a* of piston 30*a* in the course of a working stroke before exhaust apertures

134*a* are reached. As soon as aperture 112*a* is thus exposed, vapor within chamber 58*a* (now relatively enlarged) will communicate through aperture 112*a*, pipe 110*a*, aperture 108*a*, cylinder 106*a*, aperture 120*a*, passage 122*a*, aperture 124*a*, and throttle valve 132*a* to pipe 66*a* communicating with chamber 64*a* to force piston 62*a* and inlet valve rod 54*a* to stop further inflow of working fluid vapor. To ensure that this can occur both in the start-up mode and in the running mode, it is important to ensure that solid piston 117*a* has a length such that within the range of motion to which it is subjected by arm 130*a* it will definitely cover either one of apertures 104*a* and 120*a* before it exposes the other of the two. Provided solid cylinder 117*a* meets this criterion, when the engine is in the start-up mode, i.e., when its operational speed is less than the mode change speed, working fluid vapor will be allowed to enter each cylinder through a wide open vapor inlet valve assembly from the TDC until ring 42*a* of each piston passes its corresponding aperture 112*a* (substantially the bulk of the working stroke). Also, during the "running mode", cylinder 117*a* is moved by arm 130*a* to block off aperture 120*a*, and working fluid vapor from chamber 58*a* will communicate through aperture 98*a*, pipe 100*a*, aperture 104*a*, cylinder 106*a*, and throttle valve 132*a* to pipe 66*a* to exert a force on piston 62*a* tending to cut-off further intake of high pressure working fluid vapor to chamber 58*a*. However, until piston 30*a* moves away sufficiently from its TDC, inlet valve rod 54*a* cannot move valve plate 88*a* to a position where further inflow of pressurized working fluid vapor is shut off. Recall that there is an inbuilt delay due to the variable flow impedance between chambers 58 and 64. It is therefore important that the various dimensions and the specific locations of apertures such as 98 and 112 be selected for a given engine for a given application with due consideration of how the engine is to operate.

The various elements, such as valve rod 54, can be carefully dimensioned so that, for example, it moves by contact with flange 48 of the piston pressure relief valve 10° to 15° before the piston TDC. The inlet valve is thus opened at a predetermined point before piston TDC to initiate inflow of working fluid vapor. Similarly, with use of pressure from the incoming vapor in chamber 58 communicated to piston 62 to shut off the inflow, the inlet valve (i.e., coacting moving valve plate 88 and the fixed head plate 60) can be closed 15° to 25° after TDC. The exact angular positions can be selected by a user with full knowledge of the engine operating conditions. Recall that when flange 48 of the piston relief valve 46 contacts valve rod end 56, the latter pushes flange 48 against the cushioning resistance of spring 52 until flange 48 seats sealing in recess 50. The pressure of incoming vapor then holds it seated.

Figure 9:
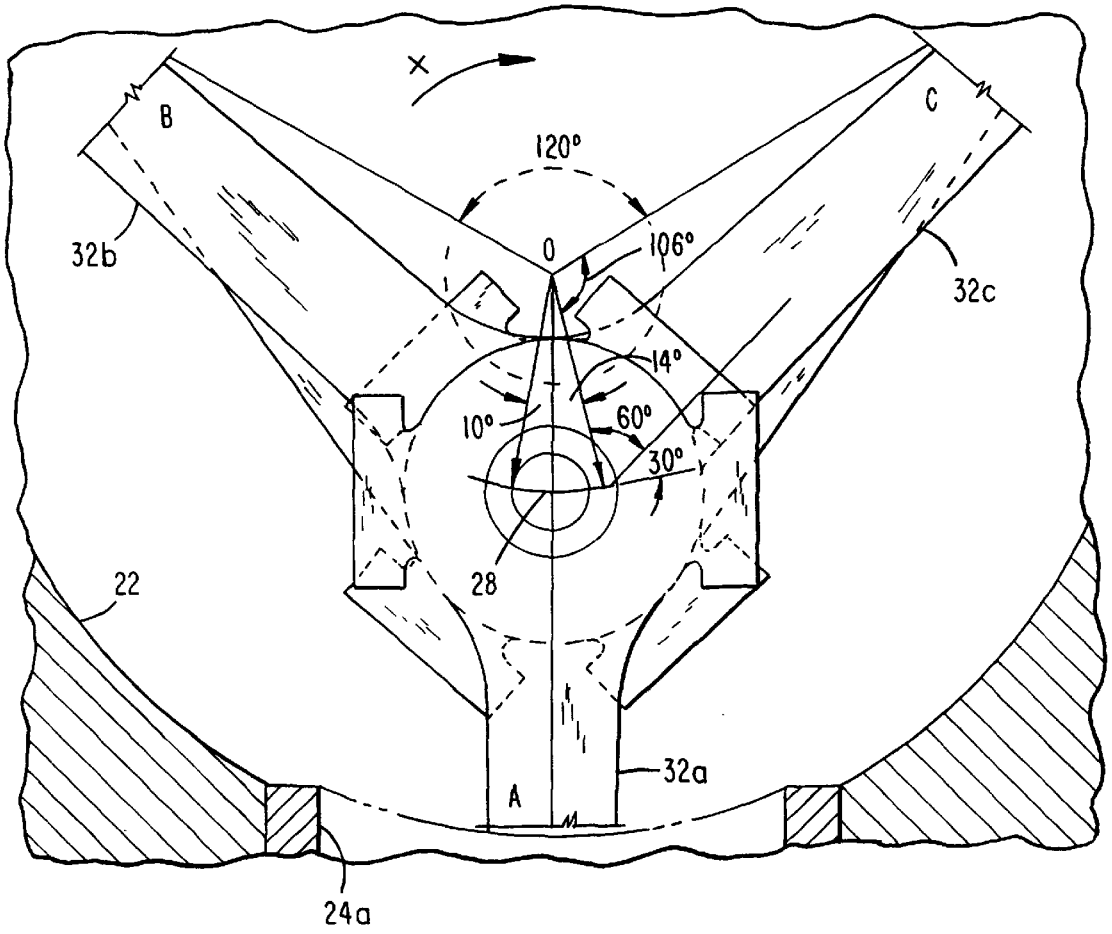
FIG. 9 is an enlarged view of the central portion of the engine as illustrated in FIG. 8.

Referring now to FIGS. 8 and 9 (the latter being a somewhat enlarged view of the central portion of FIG. 8) it should be understood that contact between the exposed surface of flange 48 of pressure relief valve 46 in a given piston 30 with the end 56 of its corresponding inlet valve rod 54 begins to permit inflow of high pressure incoming vapor at a point corresponding to AA preferably 14° before TDC. Also, in the "running mode", movement of the piston 30 away from the TDC causes further inflow to cease at a point BB preferably approximately 10° after TDC. These exemplary values of the angles are selected only for discussion of the operation of the engine. The exact values of these angles, naturally, to maximize engine efficiency must be selected with proper consideration given to the size of the engine, the working fluid selected, and the like, as is conventional in any engine design. It is, thus, assured for the selected exemplary angles that working fluid vapor enters chamber 58 by rotation of the crankshaft corresponding to the angle subtended by points AA and BB at the axis of engine rotation, a total of preferably 24° in the running mode.

Selection of the location of aperture 112 is preferably such that a given piston will not pass this point in its corresponding cylinder before the next cylinder that is to undergo a power stroke has reached its corresponding TDC. This is very important and ensures that the engine operates efficiently and that a start-up from zero rotational speed is always possible.

Applying the terms "leading piston" to one that is already in its power stroke and the term "trailing piston" to the one that is to be the next successive piston to undergo its power stroke, consider the situation when the engine is at a total stop and working fluid vapor at the vapor source attains a predetermined pressure at which a conventional pressure sensitive mechanism in the vapor line from the boiler to the engine permits delivery of the working fluid vapor to the engine cylinders. As was mentioned earlier, as the engine came to a stop last, it slowed down below the mode change speed. Each piston that was in the course of the working stroke, so long as it had not passed its aperture 112, thereafter has its inlet valve wide open.

Therefore, given this circumstance, once high pressure working fluid vapor is made available to all the cylinders, it will first enter that cylinder in which the leading piston is positioned somewhere between its TDC and its aperture 112. The working fluid vapor will enter this cylinder and act on the leading piston to initiate crankshaft rotation. Even if an extreme situation prevailed at the start of this process, i e., if the trailing piston was exactly at its TDC, there will be enough torque provided by the leading piston to take the trailing piston past its point AA towards the TDC to allow it to perform its successive power stroke and further promote rotation of the common crankshaft. Recall that there is a 60° overlap in the working strokes between the leading piston and the trailing piston as defined herein. This ensures that the just-described circumstance will always prevail and once all the cylinders are ensured a supply of pressurized working fluid vapor, a leading one of the three pistons will be in a position to initiate rotation and will have a 60° overlap within which, at worst, it will initiate the reception of working fluid vapor to the related trailing piston to continue turning the engine crankshaft once it starts rotation.

Consider two other circumstances. First, when the trailing piston has not yet reached its point AA, i.e., it is still at least 14° before its TDC in its return stroke. When this happens, torque provided by the leading piston will help the trailing piston to complete its return stroke until it reaches its point AA to receive a charge of working fluid vapor. Once this happens, that working fluid vapor will continue to flow into the "trailing" cylinder to act on the trailing piston all the way from point AA (preferably 14° before TDC) until the trailing piston passes its aperture 112. Thus, the trailing piston will have completed its first working stroke with fluid constantly available at the highest available pressure and it is thus possible for the crankshaft and any associated mechanical loads to be accelerated toward the mode change speed. The second circumstance is where the trailing piston is a few degrees past its TDC. In this circumstance, the working fluid vapor will be available not only to the leading piston which should be somewhere between 120° of rotation past its TDC and its aperture 112, but working fluid vapor will also be available to the trailing piston so that both the leading and trailing pistons together initiate rotation of the engine crankshaft. It is in this manner that the most significant advantage of the present invention is realized and the engine is always guaranteed automatic start from zero crankshaft speed as soon as working fluid vapor is made available to the engine at a predetermined pressure.

There has now been described hereinabove the detailed structure of a preferred embodiment of a multicylinder self-starting uniflow engine usable with a sealed-in closed loop system that will provide high pressure working fluid vapor to a plurality of cylinders of the engine at a predetermined initial condition, whereupon the engine will automatically start rotation, go through a start-up mode in which it can generate a relatively high torque to initiate rotation, and will at a predetermined mode change speed automatically shift to a running mode that is thermodynamically more efficient because it permits the incoming working fluid vapor to expand from an initial high pressure to a relatively low exhaust pressure. This engine has all its critical movable parts sealed-in with the system that provides the working fluid vapor. Preferably, a magnetic clutch permits convenient transfer of driving torque from the sealed-in engine crankshaft to the driven shaft across a strong sealing membrane.

As will be readily appreciated from an examination of FIGS. 2 and 3, once the engine crankshaft starts rotating, splash vanes 226 will forcibly disturb a pool 224 of a suitable lubricant which resides in the lower portion 222 of the main engine body. Pool 224, inter alia, lubricates a thrust bearing 228 that supports the lowermost portion of the engine crankshaft. Once the crankshaft starts rotating at an appreciable speed, splash vanes 226 will generate a fine mist of lubricant and a local circulation thereof in the central body portion of the engine to ensure that this mist of lubricant material enters each of the cylinders and also reaches elements such as, for example, bearing 270 supporting the top end of the engine crankshaft, bearings at the connecting rods where they connect to the common crank, swept cylindrical surfaces of all three cylinders 24, and the like. Such splash vans lubrication is well known and is highly effective in thermodynamic engines operating on a vapor cycle.

Suitable lubricants may be selected from those available commercially to ensure that any working fluid vapor that leaks past the piston rings and periodically condenses within the central region of the engine throttles out in a layer separate from the lubricant. Thus, if the lubricant is selected to have a lower specific gravity than the working fluid in its liquid state, communication may be established between the lowermost region of central engine space 222 to permit drawing away of liquid working fluid, preferably by relatively low condenser pressure provided in the system when the engine is operating. Although the details of such elements have not been illustrated in detail in the drawings (only for simplicity) liquid separators, sealed in recirculation devices, and the like as well-known in the art may be employed without undue effort. What matters most is that the sealed-in engine has the capability of very simply effecting sufficient lubrication of all rubbing and rotating parts and that the lubricant can be separated from the working fluid in known manner. Some of these parts, e.g., pneumatic mode switch valve body 102 within which solid piston 117 is slidingly contained, may be made of or provided with a liner of self-lubricating material, e.g., material impregnated with a lubricant. Selection of such elements is commonplace in the field of engine design and should present no problem to a person seeking to design an engine according to the present invention.

It may also be desirable to provide a recirculating pump, driven in known manner by the engine, to facilitate return of working fluid in its liquid form back to the location where it is converted into vaporized working fluid to power the engine.

As previously noted, a highly advantageous feature of the present invention is the provision of a relief valve in the head portion of each of the pistons to facilitate evacuation of exhausted working fluid vapor starting just before the bottom dead center of the reciprocating travel of the corresponding piston and, further, to expel a substantial portion of the remaining low pressure vapor that is still within the cylinder as the piston returns toward its TDC position. A preferred embodiment in which the pressure relief valve in the center of each piston is actuated by a spring 52 has already been described in detail. It is recognized, however, that depending on the particular application for which an engine according to this invention is designed, the relief valve body may have substantial inertia to have the necessary strength. Persons skilled in the mechanical arts working with state of the art technology must be aware that as operating conditions become more demanding the necessary solution cannot always be provided by making parts more substantial or larger in their most vulnerable dimensions because material properties also play a very important role in the durability and efficient functioning of the overall combination. In other words, if it is perceived that in a given application the relief valve according to this invention is subjected to extremely severe operational forces, the answer may not lie simply in providing a thicker relief valve flange or a stiffer actuating spring 52. With this in mind, an alternative embodiment is described hereinbelow and is claimed in the appended claims.

Reference may now be had to FIGS. 11 and 12 which, respectively, illustrate a typical piston in the running mode operation of the engine at close to its BDC while it is on its way towards its TDC (FIG. 11) and in its travel the opposite direction, i.e. , with the piston approaching its BDC having moved away from its TDC position (FIG. 12). It will be noted immediately that relief spring 52 has been eliminated entirely and is replaced, in a preferable version of this refinement, by two pivotable masses 400, preferably diametrally disposed in a plane containing the line of reciprocation of the corresponding piston. Each of the masses 400 pivots freely about a pivot 402 supported by a trunnion 404 extending inwardly from the head of the piston and inside the same. Each of the masses 400, in an exemplary geometry thereof as illustrated in enlarged view in FIGS. 13 and 14, has a general L-shape seen in side elevation view.

Figure 14:
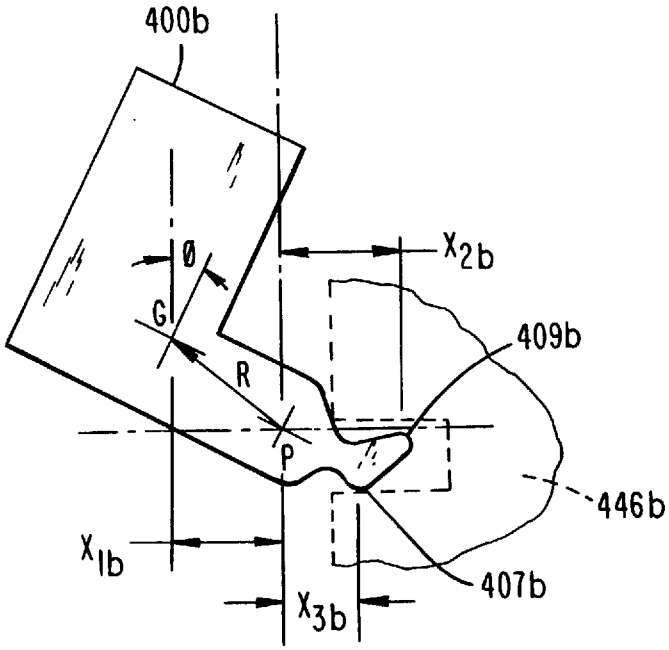
FIGS. 13 and 14 are enlarged views of a portion of the inertia-actuation element in two operational positions thereof.
Figure 13:
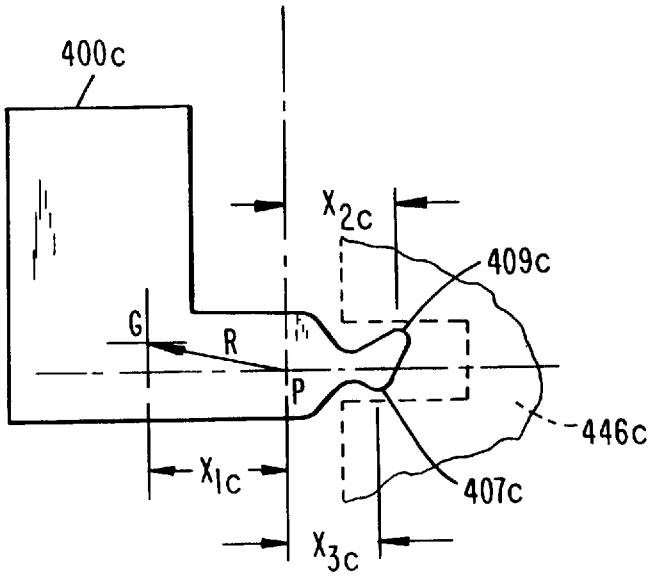

Still referring to FIGS. 13 and 14, the exemplary mass 400 (whether in the position in which it is identified as 400*b* or the position identified as 400*c*) has a center of gravity "G" that is separated from the center of pivot 402, identified as "P", by a radius "R". Referring now to FIGS. 11 and 14 together, it is seen that when the pressure relief valve is open, the masses 400 are at the position 400*b* and the center of gravity "G" has rotated away from the head of the corresponding piston (the angle of rotation being) such that the moment arm between point "P" and the center of gravity of the mass "G" is identifiable by the distance "$X_{1b}$". As seen in FIGS. 11–14, each of the masses 400 has a generally bulbous extension 406 that is slidably and rotatably engaged within a correspondingly shaped recess 408 in relief valve body 446.

From FIGS. 13 and 14 it will be seen that extension 406, in a preferred aspect of this embodiment, is shaped to have two contact portions 407 (closest to the head of the corresponding piston) and 409 oppositely thereof. In the position 400*c* of the pivotable mass, the contact portions 407*c* and 409*c* are respectively at distances $X_{3c}$ and $X_{2c}$ from the pivot center P.

For each pivotable mass, its extension 406 rotatably and slidably engages with a recess 408 (shown in broken lines in FIGS. 13 and 14) with the necessary minimal tolerance to permit smooth coaction thereof. Note in particular that $X_{3b}$ is less than $X_{2b}$ and $X_{3c}$ is less than $X_{2c}$. This is deliberate and has certain very advantageous results discussed in the following paragraphs.

In the state illustrated in FIGS. 12 and 13, corresponding to a power stroke for that cylinder, the relief valve flange 448*c* is closed into the recess in the corresponding piston head. At this time it is portion 409*c* that contacts recess 408*c* at a distance $X_{2c}$ from pivot P. At the other extreme, in the state illustrated in FIGS. 11 and 14, corresponding to an exhaust stroke for that cylinder, the relief valve 448*b* is moved away for that cylinder, the relief valve 448*b* is moved away from the corresponding piston head and it is portion 407*b* that contacts recess 408*b* at a different distance $X_{3b}$ from pivot P.

In between these positions, when inertia forces cause pivotable mass 400 to turn about pivot P, the contact distances rapidly switch, i.e., as "open" valve flange 448*b* is being shut by pivoting mass 400*b* they contact at a distance starting at $X_{2b}$ and ending at $X_{2c}$ (clearly larger than $X_{3b}$ corresponding to "valve opening" contact). This will occur as the corresponding piston moves from its BDC toward its TDC position, preferably after contact is made between rod 56 and valve flange 448. There will be a build up of pressure over the piston head and valve flange 448 thereafter to TDC due to compression of residual vapor.

In the other direction, once the piston head passes exhaust port 134 in its motion closing in toward the BDC, vapor pressure equalizes on both sides of the piston and valve flange 448 and pivotable mass 400 moves from its position 400*c* to its position 400*b* by rotating through an angle " " and contacts recess 408 at portion 407, at a distance changing from $X_{3c}$ to $X_{3b}$ (clearly smaller than $X_{2c}$ corresponding "valve closing" contact).

When the mass 400 pivots about its pivot 402, extension 406 moves a maximum distance parallel to the reciprocation axis of the piston identified as "Y" in FIG. 14. The small clearance needed between extension 406 and recess 408 can be made quite small compared to Y and, is necessary, and is not difficult to determine for a given engine piston and relief valve. It may typically be of the order of a few one-thousandths of an inch.

As a direct consequence of this motion, there is a commensurate movement of relief valve flange 448 by a distance "Y" away from its recessed closed position in the head of the corresponding engine piston. The angular rotation of mass 400 between the relief valve "closed" position and the "open" position is " ".

During operation of an engine provided with inertially actuated relief valve means as just described, as the a piston approaches its BDC position from its TDC position, the piston decelerates and, as a direct consequence, the corresponding masses 400 pivot about pivots 402 so as to, together, overcome the corresponding inertial force being felt by the relief valve sufficiently to force it open.

Persons skilled in the mechanical arts will appreciate that the particulars of the extension 406 discussed in detail hereinabove ensure that the force applied by each pivotable mass 400 to the corresponding inertially actuated pressure relief valve body 446 by contact with recess 408 thereof is not the same when the valve is to be opened and when it is to be closed. When the pressure relief valve is to be closed from its open position (i.e., going from the position of FIG. 14 to that of FIG. 13), the moment arm "closing ratio" at which the inertial force of the mass centered at G acts is $(X_{1b}/X_{2b})$. This occurs as the piston approaches its TDC in the exhaust stroke. Similarly, when the pressure relief valve is to be opened from its closed position (i.e. , going from the position of FIG. 13 to that of FIG. 14) the corresponding moment arm "opening ratio" is $(X_{1c}/X_{3c})$.

Since at all times $X_{1c}$ is greater than $X_{1b}$ and $X_{3c}$ is less than $X_{2b}$, as clearly seen from FIGS. 13 and 14, this ensures that the "opening ratio" is larger than the "closing ratio" at all times. The operational consequence is that the pressure relief valve will tend to open up promptly as soon as the corresponding piston passes its exhaust port 134, thus promptly exhausting low pressure vapor and improving efficiency. Equally significantly, each relief valve will not be closed with comparable force as the piston approaches it TDC. This will facilitate better purging of residual exhaust vapor and will keep the relief valve open until inlet valve rod end 56 contacts pressure relief valve flange 448. At that time, the manses 400 will not only assist rod end 56 but, very importantly, will absorb some of the impact force in going "closed". Thus the engine will exhaust each cylinder exceptionally thoroughly, yet the pressure relief valve flange will suffer lesser forces and will last a long time.

In the exemplary embodiment illustrated in FIGS. 13 and 14, there are two diametrally opposed masses 400 effecting this opening action. Persons skilled in the art will immediately appreciate that as the piston decelerates so does the relief valve and that, left to itself, it will have a tendency to stay in its closed position and it is this tendency that must be overcome by the combined action of the two pivotable masses 400. Such persons will also appreciate that as the piston passes its BDC position and begins its return motion towards its TDC position, the direction of acceleration initially remains as it was before the piston reached its BDC position. As a consequence, the relief valve will be held in its "open" position as the piston returns towards its TDC position and, consequently, more of the residual vapor that is present in the cylinder is exhausted.

The operation of the engine according to this invention otherwise is very similar to that as described in relation to the spring-actuated relief valve embodiment. In other words, it is only when a piston passes the corresponding apertures 134 within its corresponding cylinder that the exhausted working fluid vapor is evacuated from the cylinder and, because the engine outside the pressurized zones is maintained at vacuum as hitherto described, opening of the relief valve in the piston begins to facilitate evacuation of this exhausted vapor.

In other words, the pivotable masses 400 utilize the natural acceleration and deceleration of the corresponding piston to actuate the slidably contained relief valve for that piston as necessary for efficient operation of the engine. Preferably, to avoid any imbalance of forces due to interaction between the earth's gravitational field and the accelerations generated by piston motion, the pivotable masses 400 should be arranged to pivot about vertical axes 402, i.e., in a horizontal plane. This is easily done if an even number of pivotable masses 400 is employed. With odd numbers of pivotable masses 400, additional balancing in known manner may be provided.

When the engine piston is close to its TDC position, the end 56 of rod 54 will, of course, contact the front surface of flange 448. This is true whether the piston is moving slowly, as when the engine is in the start-up mode, or when the engine is moving at a higher operational speed, e.g., as when the engine is in its running mode. In either case, once the relief valve is closest to its corresponding engine piston, any residual working fluid vapor that remains trapped in the cylinder will experience an increase of pressure which will tend to further assist in closure of the relief valve into the corresponding engine piston and will cushion arrival of the piston to its TDC.

As already mentioned, engines designed according to the present invention can be utilized in a number of applications and, correspondingly, the actual size, mass and materials selected for various components as taught herein must depend upon the particular application at hand. Persons skilled in the mechanical arts would necessarily have the skill to select the size, the mass and the material for each of the elements as most appropriate under the prevailing circumstances. What is particularly important to appreciate is that whether it is by means of a spring or by coaction with pivotable masses as just described, the pressure relief valve must close as its corresponding engine piston approaches its TDC and must open when the pressure on both sides of the relief valve is equalized by passage of the piston past the corresponding exhaust ports 134 in its corresponding cylinder.

A person designing an engine according to this invention will, therefore, select the shape, the mass and the dimensions "R", "$X_1$", "$X_2$" and "$X_3$" (and correspondingly "Y") as appropriate for the engine in light of its intended use. Only one exemplary shape has been illustrated in FIGS. 13 and 14, and then only for two diametrally opposed masses 400 in two extreme positions thereof, although numerous other variations in accordance with this teaching are of course possible. In principle, only a single pivotable mass would suffice and, should it be deemed desirable, more than two pivotable masses may be utilized. Such details are believed to be merely incidental to proper design according to this invention. Although only the best mode of the inertially actuated pressure relief valve has been discussed in fine detail, persons skilled in the art will appreciate that even if the extension 406 were simply spherical or of other simple shape the mechanism would provide the desired function although perhaps somewhat less efficiently than that disclosed in detail herein.

Provision of such inertially actuated relief valves may, in fact, improve existing engine designs and such an improvement is, of course, at the heart of the present invention. Furthermore, engines designed in accordance with the balance of the present disclosure in addition to the inertial actuation mechanism for operating the pressure relief valve in each piston offer singular advantages of high efficiency, freedom from frequent and routine maintenance, and particular suitability for operation with systems utilizing solar power. The present invention, therefore, also comprehends such engines.

In the preferred embodiments, as discussed hereinabove, the inlet valve mechanism corresponding to each cylinder of the engine actually comprises two cooperating valves: these being the main engine cylinder inlet valve with its sliding plate 88 and the mode changing valve 102. In yet another aspect of this invention, one intended to provide even more precise control over the engine performance, additional structure may be added as discussed hereinbelow with particular reference to FIGS. 15 and 16.

The proposed improvement involves both the inlet valve small piston 64 and somewhat modified structure to enable fine-tuning of valve 102.

As previously described, the period for which inlet valve plate 88 of each cylinder is kept in its valve-open position determines the amount of working fluid vapor that is injected into the corresponding cylinder at the maximum available pressure at about or soon after the corresponding piston passes its top dead center (TDC) position. Once the engine has attained its "running mode", if the amount of high pressure working fluid vapor that is thus injected per stroke is too larger then some of the enthalpy contained in each vapor charge will be only partially utilized by the time the corresponding piston reaches the end of its working stroke and, consequently, will simply be lost in the exhausted working fluid vapor. In other words, since it is an important goal of this invention to obtain the maximum possible useful work output from each vapor charged, it is important to carefully regulate the amount of high pressure working fluid admitted by the inlet valve means for each working stroke.

To obtain the desired improvement, by somewhat modifying the physical structure of the mode changing/fine-tuning valve means of the earlier-discussed embodiments, it is proposed to utilize the pressure difference in each cylinder between an effective average or moan pressure $P_2$ as prevails in the cylinder when the piston is close to its TDC and a mean or effective pressure $P_1$ that prevails in the cylinder when the piston is close to its bottom dead center (BDC) position. This pressure differential is utilized to fine-tune a period of time for which the high pressure working fluid vapor is admitted into the cylinder at its highest pressure.

In the previously described embodiments sliding valve piston 117 closes or opens a pressure access path under the influence of working fluid vapor pressure communicated through ports 98 and 112 close to the TDC and BDC respectively through passages 108, 122 and 104. The unmodified structure is best understood with reference to FIGS. 1A–1C and 5–7. Modifications to this structure, as discussed more fully hereinbelow, are best understood with reference to FIGS. 15 and 16.

Before discussing details of the structure, it may be helpful to understand the underlying principles involved in its intended operation. Ideally, when the engine is in its "running mode," the inlet valve means will allow injection of working fluid vapor at its highest available pressure from about the TDC position of the piston until the working fluid entering the cylinder occupies between one sixth and one seventh of the maximum of the cylinder while the piston is moving away from the TDC. Taking some exemplary figures for purposes of the present discussion, if an engine according to this invention were operated with working fluid available at a high pressure of 100 psi with an available condenser pressure of 9.6 psi, then $P_2$ at TDC would be approximately 100 psi and $P_1$, when the piston is just past port 112, will be approximately 27 psi. Under these conditions, the pressure ratio $P_1/P_2$ will be approximately 27/100.

If inlet valve plate 88 stays in its valve-open position too long, i.e., it is moved to its closed position too slowly, then more than an optimum amount of working fluid vapor will enter the cylinder at its highest available pressure and, consequently, $P_1$ will be higher than 27 psi, say 50 psi, and the ratio $P_1/P_2$ then will be higher than 27/100, e.g., 50/100. As persons skilled in the art will immediately appreciate, the working fluid vapor exhausted at 50 psi would, in effect, carry away unutilized enthalpy in an amount higher than would be the case if $P_1$ were 27 psi.

The compression spring 232 plus the force due to pressure $P_1$ acting on the end face of piston 117 is equal to the net force due to pressure $P_2$ acting on the opposite effective end face of piston 117 (less the end face of valve stem 116). Impulse force is equal to the momentum as determined by the formula $F\,t=-mv$. Impulse force $F\,t$ and momentum are measured in the same units, Newton.sec or lbs.sec (in the case of vapor pressure). F is force, t is the time interval of the action, m is the mass of the body impacted and v is that body's subsequent velocity resulting from this impact. This formula applies directly to the principles of this improvement.

$$F_{spring} \cdot t_{spring} + (P_1)(A_1)(t_1) = (P_2)(A_2)(t_2)$$

Wherein:

$F_{spring}$=the force of the compression spring.

$t_{spring}$=the time interval in seconds that the compression spring acts on valve stem 116 during the upstroke/downstroke (roughly 1800 RPM's/60 sec. per minute).

$P_1$=pressure in the chamber at opening 108.

$P_2$=pressure in the chamber at the opening 104.

$t_1$=time (sec.) of pressure $P_1$ $t_2$=time (sec.) of pressure $P_2$ $A_1$=the area of piston 117 on the $P_1$ side.

$A_2$=the area of piston 117 on the $P_2$ side.

In a given stroke, pressure $P_2$ will act on the compression spring, $F_{spring}$, essentially maintaining an equilibrium position. It is pressure $P_1$ that offsets this equilibrium,. If pressure $P_1$ is less, pressure $P_2$ will have a greater effect on force $F_{spring}$, moving the needle valve stem 116 to a more closed position (in FIGS. 15 and 16, more to the left). This closing action of the needle valve will inhibit the flow of vapor pressure $P_2$ to the inlet valve small closing piston 62. The needle valve controls the rate of the closing of the chamber inlet valve, hence, as explained above, inhibiting the closing speed of the inlet valve will increase the volume of vapor incoming into the cylinder at TDC.

Figure 15:
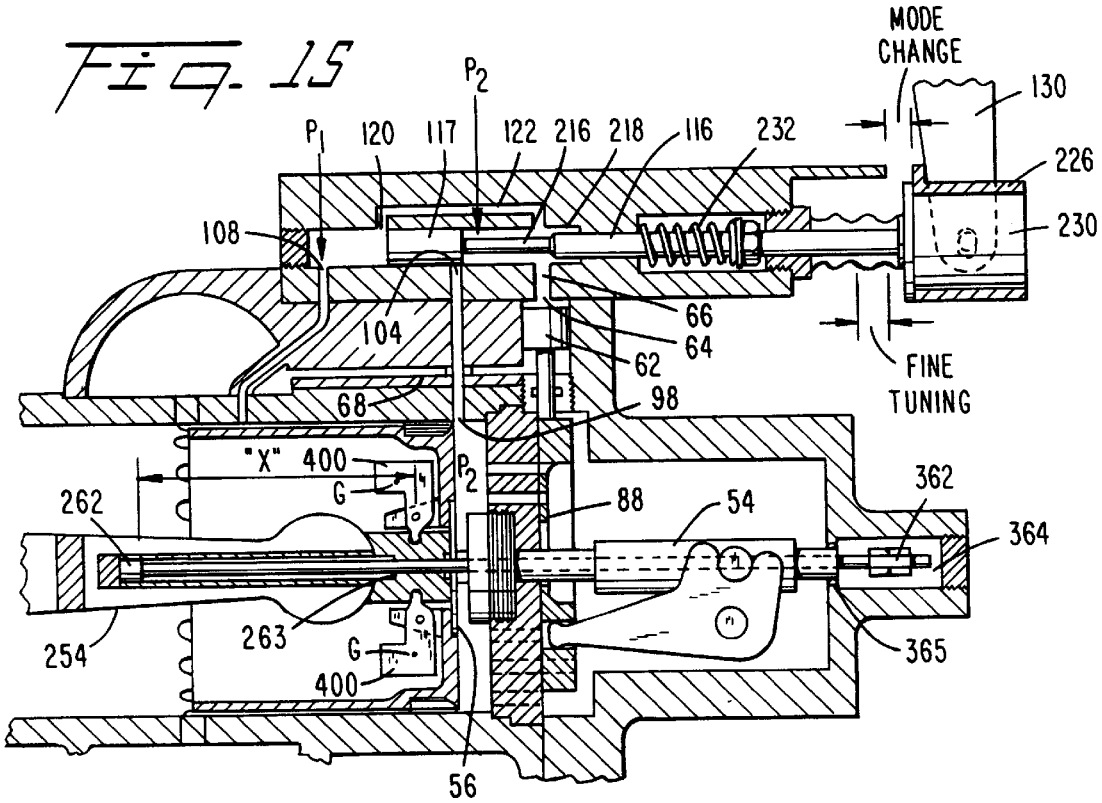
FIGS. 15 and 16 illustrate, in cross-sectional views, two positions of an improved mode change/fine tuning valve mechanism to control fluid flow to the engine.
Figure 16:
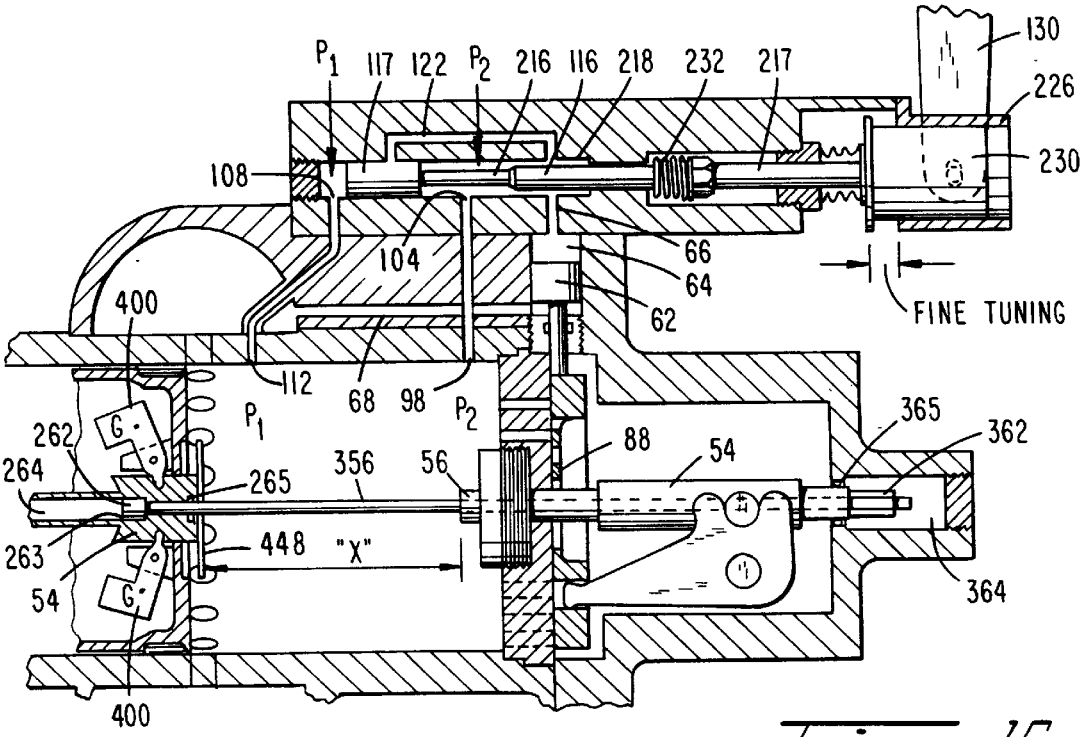

If pressure $P_1$ is greater, this pressure will force the needle valve more open, allowing the vapor pressure $P_2$ at TDC to close the inlet valve more rapidly, reducing the closing time and therefore reducing the volume of injected vapor at TDC. In FIGS. 15 and 16, the needle valve stem would move to the right, opening the valve, accessing more rapidly pressure $P_2$ at port 98 to the small piston at chamber 64.

The term "composite pressure differential" may be used to describe the mean effective pressure differential between $P_2$ and $P_1$ during a stroke. In fact, the engine operation will be in the 1800 rpm range. Pressures $P_1$ and $P_2$ in actuality fluctuate extensively during each stroke. Designed into this improvement is a weighted mass 230. To establish a composite effective mean pressure differential in the running mode, in order to prevent unacceptable oscillation of stem 116 and piston 117 of the mode changing/fine-tuning mechanism, weight 230 is attached to stem 116. This weight 230 slides inside a sleeve 226 and is connected to lever 130, and joint 126/128. The inertia (momentum) of this weight is selected so that at 1800 rpm it will stabilize the mean effective pressure differential. In the above formula, F t=−mv, momentum is gained, countering the impulse forces, using the momentum (−mv) to stabilize the fluctuating impulse forces of varying pressures $P_2$ and $P_1$. This weight 230 will stabilize the fine-tuning mechanism and will find its operational equilibrium. The weight 230 in sleeve 226 will slowly slide to find its balanced position.

The pressure $P_1$ at port 112 will prevail for only a short interval during the piston stroke. But the accumulated force at 1800 RPM's will offset the more steady forces of pressure $P_2$ and $F_{spring}$. In FIGS. 15 and 16, the size and suggested movement of the needle valve stem 116 are somewhat exaggerated to illustrate their function. If the space between the cylinder wall of the needle valve stem 118 and the needle valve stem 116 is more restricted, a smaller movement of the needle (in and out of the valve cylinder) will suffice to vary the vapor flow from inlet 104 to the small piston chamber 64 to fine tune the inlet valve closing speed. The relative sizes of areas $A_2$ and $A_1$ at the ends of piston 117 determine the relative force provided by the pressures $P_2$ and $P_1$ respectively acting thereon. Because pressure $P_2$ will be much higher than pressure $P_1$, area $A_2$ should be smaller than area $A_1$. Area $A_1$, facing $P_1$, will be much larger than area $A_2$, facing $P_2$, because the cross section of the needle valve stem 116 will take away area from the cross section of piston 117, accentuating the accumulated effective force of pressure $P_1$. Of course the cross-section of the cylinder 218 of the needle valve will be larger than the cross-section of stem 216, allowing flow from ports 104 and line 122 to line 66. Even so, with the diameter of needle 116 being in close tolerance with its cylinder wall 218, only a minimum movement of the needle valve stem 116 will be required to vary the flow of the pressurized vapor to the small piston affecting the closing speed of the inlet valve 88.

Note that the force bias provided by compression spring 232 is adjustable so that the mode changing/fine tuning mechanism can be adjusted, just as a mechanic would fine-tune the valve operation of a cam-operated valve mechanism.

The operation of the mode-changing elements is not impaired by the above-described improvement of the fine-tuning mechanism. The mode changing mechanism accesses port 112 to chamber 64 of the inlet valve closing mechanism in the start-up mode and port 98 to chamber 64 in the running mode. This function does not change in this improvement. In the start-up mode, inlet 104 is closed by mode changing valve piston 117 (note the drawing in FIG. 15). In this start-up mode, port 112 is accessed to chamber 64. Therefore $P_1$ will be greater or equal to $P_2$. Pressure $P_2$ will not force the mode change. Line 122 will access port 112 to chamber 64. The compression spring 232 will maintain the mechanism in the start-up mode position (in FIG. 15, to the right). Lever arm 130 will move the internal needle valve stem 116, mode changing piston 117, and weight 230, to the running mode position. This movement may be a short distance, enough to open port 104 and close port 120. When the mode change has occurred, lever arm 130 will not move further (FIG. 16 shows the left-fitted position of lever 130).

Weight 230 slides within sleeve 226 which is attached to lever arm 130 by pin 126 in slot 128, as described. Weight 230 has a flange-abutting sleeve 226 which allows lever 130 to push on the mechanism and stem 116, compressing spring 232. In the running mode, the fine-tuning mechanism operates independently of the mode-changing device. In other words, after the shift from the start-up mode to the running mode, the needle valve stem 116 can freely shift from the completely open position to a more closed position.

In addition to the above improved fine-tuning mechanism, FIGS. 15 and 16 show an improved positioning of the inlet valve closing mechanism. This closing mechanism is located in the earlier described embodiments on the far side of the inlet valve on the main axis from the cylinder and piston, and it was actuated by shaft 54 in contact with the main piston at 56 during TDC of the piston up stroke. By moving the small piston of the inlet valve closing mechanism around to the side of the sliding inlet valve plate 88, the pneumatic tubes 66 and 68 are shortened considerably, reducing the amount of vapor wasted during the pneumatic action of the vapor pressure on the small piston of the inlet valve. Also the action of the small piston is more direct and decisive, since the movement of the small piston is increased. This mode changing/fine-tuning valve means operates very compactly the inlet valve closing speed which it serves. Likewise any condensate from this small piston action in chamber 64 will seep past the small piston and pass directly through the line 68 to the exhaust vacuum.

In this engine structure, in a three-cylinder configuration, the angular position between the axis of each cylinder is 120°, allowing out of the 180° 's corresponding to each down stroke, a 60° overlap. With three cylinders and during this 60° overlap, the engine leading piston must pass TDC, the port 112 at near BDC must do its work and the respective cylinder must exhaust its vapor. Of course, at start-up the engine speed can be low, but must develop enough rotational momentum to insure that the engine will kick itself off. The exhaust ports of this engine design are practically replaced by the back-pressure relief valve 448. The back-pressure relief valve 448 is actuated by the inertia of its weighted levers 400 at BDC when the chamber pressure in the cylinder stroke drops as the piston passes the exhaust ports. At BDC this inertia is at its maximum. The back pressure relief valve 448 opens with the pressure drop at the exhaust, allowing the exhaust ports to be much nearer the BDC of the stroke. Because the back-pressure relief valve 448 will remain open throughout the upstroke, the chamber will clear itself even during part of the upstroke. These design features allow the exhaust ports to be nearer BDC. By lowering the position of the exhaust ports, more space is gained in the 60° portion of the downstroke of the exemplary three cylinder engine configuration.

It is believed that these improvements increase the efficiency of the pneumatic system and are accomplished with minimum additional complexity.

Certain improvement to further increase engine performance, efficiency, and reliability are also illustrated in FIGS. 15 and 16.

It must be appreciated that the inlet valve and back-pressure relief valve of each cylinder chamber will remain in their respective positions as the start-up/stop sequence ends after the engine stops, under normal conditions and if the engine is not disturbed thereafter. As the engine stops, the engine shifts from the running mode to the start-up mode, preparing for the next start-up. The valves automatically take the correct sequential position for the next start-up. However, if the engine is moved or its operation towards it stopped position is disrupted, the inlet valves and back-pressure relief valves may change their relative positions from open to closed or vice versa. If this occurs, the engine may not be ready, i.e., the valve may not all be positioned or sequentially set-up for the next start-up.

If the inlet valves or back-pressure relief valves do change position improperly in this manner, the vapor pressure from the boiler will not be able to enter the cylinder chamber to open any of the respective inlet valves to start the engine, utilizing the start-up mechanism. FIGS. 15 and 16 illustrate an improvement which ensures that if there is an inlet valve or back pressure relief valve position change, the drive shaft can be physically turned one complete revolution to reset the sequence, so that the engine can automatically start-up. Rotating the drive shaft in this way would be necessary only if the valve sequence is disrupted.

This improvement is a reset means for the inlet valve and back-pressure relief valve 448. It is not a replacement for the back-pressure relief valve 448 or for the start-up means through port 112. The start-up moans as described earlier ensures that the inlet valve closes before the piston down-stroke uncovers the exhaust 134. The pneumatic inlet closing means prevents excessive pressure loss from the boiler, because the valve at sliding plate 88 closes before the piston uncovers the exhaust.

When the contact surface 56 of shaft 54 is in the "inward" position towards the engine center (FIG. 16 shown the position of 56), the inlet valve is closed. When the back-pressure relief valve 448 surface is in the "outward" position from the engine center (FIG. 16 shows this position of 448), the back-pressure relief valve is open. The distance between shaft surface 56 on shaft 54 and the upper surface 448 of the back-pressure inlet valve is a fixed distance "X". Rod 356 slides along the axis and through shaft 54 into space 364. Blocker 262 in space 264 butts against stopper 263 in the open position and against stopper 263 in the open position and against stopper 254 in the closed position. Blocker 362 in space 364 butts against inlet valve shaft 54 in the open position and surface 56 of shaft 54 butts against the upper surface of the back-pressure relief valve 448 in the cylinder chamber when in the closed position. This blocker action brackets the movement of distance "X" along rod 356. FIGS. 15 and 16 illustrate this function. The blocker position 362 may be adjustable to distance "X". Ring gasket 365 provides a vapor barrier for rod 356 into space 364 and ring gasket 265 for space 264.

The detailed description provided herein relates only to the preferred embodiments and the best mode known for practicing this invention. Persons skilled in the art will no doubt find it obvious to modify various components of the described embodiment to suit particularized needs. All such modifications in the spirit of the present invention, as claimed in the claims appended hereto, are regarded as comprehended within the present invention.

What is claimed is:

1. Apparatus for providing a rotary mechanical power output when supplied with an expandable working fluid at a predetermined initial condition, comprising:

a multicylinder, self-starting single crankshaft, reciprocating piston engine with at least three cylinders connected to a common crankshaft, at least one of a speed-responsive first means, pressure-responsive first means or temperature-responsive first means that forcibly adjusts its position in correspondence with an output speed of the engine, with a pressure of the working fluid or a temperature of the working fluid, respectively; and a second means for controlling the start and stop of an inflow of said expandable working fluid at said initial condition, into individual engine cylinders in a prescribed sequence as a function of the position of each individual piston with respect to its top dead center during a working stroke, in correspondence with said position of said first means, wherein said second means includes:

a mode change valve means at each cylinder connected to the first means;

an inlet valve means at each cylinder governed by the mode change valve means as well as actuated by the piston itself; and said mode change valve means includes means by which the closing rate of the inlet valve means varies based on the pressure differential between top dead center and bottom dead center.

2. A mechanism for ensuring self-starting of a multi-cylinder, single crankshaft, reciprocating piston engine with plural cylinders connected to a common crankshaft to provide a rotational output upon provision thereto of a supply of an expandable working fluid at a predetermined initial condition, comprising:

at least one of a speed-responsive first means, pressure-responsive first means or temperature-responsive first means that forcibly adjusts its position in correspondence with an output speed of the engine, with a pressure of the working fluid or a temperature of the working fluid, respectively; and a second means for controlling the start and stop of an inflow of said expandable working fluid at said initial condition, into individual engine cylinders in a prescribed sequence as a function of the position of each individual piston with respect to its top dead center during a working stroke, in correspondence with said position of said first means, wherein said second means includes:

a mode change valve means at each cylinder connected to the first means;

an inlet valve means at each cylinder governed by the mode change valve means as well as actuated by the piston itself; and said mode change valve means includes means by which the closing rate of the inlet valve means varies based on the pressure differential between top dead center and bottom dead center.

3. Apparatus for providing a rotary mechanical power output when supplied with an expandable working fluid at a predetermined initial condition, comprising a multicylinder, self-starting single crankshaft, reciprocating piston engine (20) with at least three cylinders (24) connected to a common crankshaft (26), at least one of a speed-responsive first means, pressure-responsive first means, or temperature-responsive first means that forcibly adjusts its position in correspondence with an output speed of the engine (20), with a pressure of the working fluid or a temperature of the working fluid, respectively; and a second means for controlling the start and stop of an inflow of said expandable working fluid at said initial condition, into individual engine cylinders (24) in a prescribed sequence as a function of the position of each individual piston (30) with respect to its top dead center during a working stroke, in correspondence with said position of said first means.

4. The mechanism of claim 3, wherein:

said first means has a first position corresponding to zero output speed, a second position corresponding to a predetermined mode change output speed, and a third position corresponding to engine output rotation at higher than said mode change output speed, said engine being in a start-up mode below said mode change output speed and in a running mode at higher output speeds.

5. The mechanism of claim 4, wherein:

said second means acts during each complete crankshaft rotation to enable the start of an inflow to each cylinder in which the corresponding piston is between said first piston position and a second piston position more distant relative to TDC and stops said inflow at said second piston position so long as the engine is in said start-up mode but stops said inflow at a third piston position intermediate said first and second piston positions when the engine is in said running mode.

6. The mechanism of claim 5, wherein:

each of said cylinders is formed with an exhaust port that is exposed to substantially exhaust working fluid from the cylinder therethrough when the corresponding piston moves to a fourth piston position further away from the TDC than said second piston position, and said substantial exhaustion continues thereafter until the piston passes through its bottom dead center (BDC) and returns past the exhaust port to said fourth piston position.

7. The mechanism of claim 6, wherein:

said first means comprises a plurality of rotatable weights mutually linked to move, by centrifugal forces, a linked connector at each cylinder to corresponding first, second and third positions of said first means; and said second means comprises individual mode change valve means at each cylinder, cooperating with said connector thereat, for selectively placing working fluid in the cylinder in communication with an inlet valve means movable to control said stop and start of said working fluid inflow to the cylinder.

8. The mechanism of claim 7, wherein:

said inlet valve means comprises an inlet valve rod having at one end an and piston slidably containing in a valve cylinder that communicates with said mode change valve means to apply a differential force on the end piston to move the inlet valve rod along the corresponding cylinder axis, the other end of the inlet vale rod slidably projecting into an end face of the corresponding cylinder to make forcible contact with a part of the piston sliding therewithin between said first and third piston positions thereof.

9. The mechanism of claim 8, wherein:

said inertially-actuated relief valve means comprises a relief valve slidably supported centrally in a cylindrical aperture formed in the piston, such that when the working fluid acting on the piston is at close to a predetermined low pressure the relief valve moves to an open position outwardly of an end face of the piston to allow working fluid passage through the piston and when said relief valve is pushed against the piston it seals shut thereagainst.

10. The mechanism of claim 9, wherein:

after said piston reaches said first piston portion in its return toward TDC there is forcible contact between an end face of said relief valve and the projecting end of the corresponding inlet valve rod, whereby the relief valve seals shut at the piston and the inlet vale rod is urged to a position enabling inflow of working fluid.

11. The mechanism of claim 10, wherein:

the working fluid is a vapor.

12. The mechanism of claim 6, wherein:

at least the common crankshaft, cylinders and inlet valve means are sealed off from the ambient atmosphere and rotational torque output is transmitted through a magnetic clutch to a rotating output shaft.

13. The mechanism of claim 8, wherein:

said inertially-actuated relief valve comprises a valve body supported to be slidable along a reciprocation axis of the piston and having a substantially flat end flange located at the top of the corresponding piston, said valve body having at least one outside recess shaped to slidably and pivotally engage a correspondingly shaped actuating member locatable therein, and at least one mass pivotably supported adjacent said flange inside said piston, said pivotable mass being formed with an extension shaped to serve as said actuating member engaging said relief valve body such that when said piston is subjected to acceleration and deceleration close to its top dead center and bottom dead center positions said pivotable mass experiences an inertial force sufficient to cause pivoting thereof with consequential movement of said relief valve body engaged therewith.

14. The mechanism of claim 13, wherein:

said extension is shaped so as to apply a greater force to said pressure relief valve when acting thereon to open the pressure relief valve than when acting to close the pressure relief valve to the corresponding piston head.

15. The mechanism of claim 14, wherein:

said extension shape provides contact between said extension and said valve body recess at a first distance from the center of the pivot supporting said pivotably supported mass when said pressure relief valve is being opened and at a second distance from said pivot center when said valve is being closed, said first distance being larger than said second distance.

16. The mechanism of claim 13, wherein:

said pressure relief valve opens only after the corresponding cylinder commences exhaustion of working fluid and closes only after making contact with the corresponding inlet valve rod.

17. The mechanism of claim 13, wherein:

said valve body is formed to have two of said recesses symmetrically disposed about said reciprocation axis and two of said pivotably supported masses each with an extension slidably and pivotably engaging one each of said recesses, whereby corresponding inertial forces are symmetrically applied to said valve body.

18. The mechanism of claim 5, wherein:

one of the pistons is disposed so as to just pass its TDC position before at least one other piston connected to their common crankshaft passes its second piston piston.

19. The mechanism of claim 3, wherein:

the axes of each of the cylinders are horizontal and pass radially through a vertical rotational axis of their common crankshaft.

20. The mechanism of claim 19, further comprising:

lubrication means driven by the crankshaft to facilitate lubrication of at least the pistons and crankshaft.

* * * * *